US009695654B2

(12) United States Patent
Stephenson et al.

(10) Patent No.: US 9,695,654 B2
(45) Date of Patent: Jul. 4, 2017

(54) WELLHEAD FLOWBACK CONTROL SYSTEM AND METHOD

(71) Applicant: Halliburton Energy Services, Inc., Houston, TX (US)

(72) Inventors: Stanley V. Stephenson, Duncan, OK (US); Joseph A. Beisel, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 408 days.

(21) Appl. No.: 13/692,839

(22) Filed: Dec. 3, 2012

(65) Prior Publication Data

US 2014/0151062 A1 Jun. 5, 2014

(51) Int. Cl.
*E21B 21/01* (2006.01)
*E21B 34/08* (2006.01)
*E21B 43/12* (2006.01)

(52) U.S. Cl.
CPC ..... *E21B 21/01* (2013.01); *E21B 34/08* (2013.01); *E21B 43/12* (2013.01)

(58) Field of Classification Search
CPC ..... E21B 34/08; E21B 34/10; E21B 43/00; E21B 43/006; E21B 43/12; E21B 43/16; E21B 21/01; F15D 1/0015; F15D 1/02
USPC ..... 166/222, 304, 306, 316; 137/599.01, 137/601.18, 808, 809, 810, 811
See application file for complete search history.

(56) References Cited

U.S. PATENT DOCUMENTS 553,727 A 1/1896 Van Sickle
1,329,559 A * 2/1920 Tesla ..... F15C 1/00 137/842
2,140,735 A 12/1938 Clarke et al.
2,324,819 A 7/1943 Butzbach
2,762,437 A 9/1956 Egan et al.
2,849,070 A 8/1958 Maly
2,945,541 A 7/1960 Maly et al.
(Continued)

FOREIGN PATENT DOCUMENTS

EP 0834342 B1 2/2003
EP 1672167 A1 6/2006
(Continued)

OTHER PUBLICATIONS

Dictionary Definition: "collinear"; http://www.thefreedictionary.com/collinear.*
(Continued)

*Primary Examiner* — Blake Michener
*Assistant Examiner* — Christopher Sebesta
(74) *Attorney, Agent, or Firm* — John W. Wustenberg; Baker Botts L.L.P.

(57) ABSTRACT

A wellbore servicing system disposed at a wellbore, the wellbore servicing system comprising at least one wellbore servicing equipment component, wherein a flow path extends from the wellbore servicing system component into the wellbore, and a flow-back control system, wherein the flow-back control system is disposed along the flow path, and wherein the flow-back control system is configured to allow fluid communication via the flow path in a first direction at not less than a first rate and to allow fluid communication via the flow path in a second direction at not more than a second rate, wherein the first rate is greater than the second rate.

20 Claims, 8 Drawing Sheets

(56) References Cited

U.S. PATENT DOCUMENTS 2,981,332 A 4/1961 Miller et al.
2,981,333 A 4/1961 Miller et al.
3,091,393 A 5/1963 Sparrow
3,186,484 A 6/1965 Waterman
3,216,439 A 11/1965 Manion
3,233,621 A 2/1966 Manion
3,233,622 A 2/1966 Boothe
3,256,899 A 6/1966 Dexter et al.
3,266,510 A 8/1966 Wadey
3,267,946 A 8/1966 Adams et al.
3,282,279 A 11/1966 Manion
3,375,842 A 4/1968 Reader
3,427,580 A 2/1969 Brock
3,461,897 A * 8/1969 Kwok ..... 137/809
3,470,894 A 10/1969 Rimmer
3,474,670 A 10/1969 Rupert
3,477,506 A 11/1969 Malone
3,486,975 A 12/1969 Ripley
3,489,009 A 1/1970 Rimmer
3,515,160 A 6/1970 Cohen
3,521,657 A 7/1970 Ayers
3,529,614 A 9/1970 Nelson
3,537,466 A 11/1970 Chapin
3,554,209 A 1/1971 Brown et al.
3,566,900 A 3/1971 Black
3,575,804 A 4/1971 Ripley
3,586,104 A 6/1971 Hyde
3,598,137 A 8/1971 Glaze
3,620,238 A 11/1971 Kawabata
3,638,672 A 2/1972 Smith et al.
3,643,676 A 2/1972 Limage et al.
3,670,753 A 6/1972 Healey
3,704,832 A 12/1972 Fix et al.
3,712,321 A 1/1973 Bauer
3,717,164 A 2/1973 Griffin
3,730,673 A 5/1973 Straitz, III
3,745,115 A 7/1973 Olsen
3,754,576 A 8/1973 Zetterström et al.
3,756,285 A 9/1973 Johnson et al.
3,776,460 A 12/1973 Fichter
3,850,190 A 11/1974 Carlson
3,860,519 A 1/1975 Weatherford
3,876,016 A 4/1975 Stinson
3,885,627 A 5/1975 Berry et al.
3,895,901 A 7/1975 Swartz
3,927,849 A 12/1975 Kovalenko et al.
3,942,557 A 3/1976 Tsuchiya
4,003,405 A 1/1977 Hayes et al.
4,029,127 A 6/1977 Thompson
4,082,169 A 4/1978 Bowles
4,108,721 A 8/1978 Drzewiecki et al.
4,127,173 A 11/1978 Watkins et al.
4,134,100 A 1/1979 Funke
4,138,669 A 2/1979 Edison et al.
4,167,073 A 9/1979 Tang
4,167,873 A 9/1979 Bahrton
4,187,909 A 2/1980 Erbstoesser
4,259,988 A * 4/1981 Singh ..... 137/812
4,268,245 A 5/1981 Straitz, III
4,276,943 A 7/1981 Holmes
4,279,304 A 7/1981 Harper
4,282,097 A 8/1981 Kuepper et al.
4,286,627 A 9/1981 Graf
4,287,952 A 9/1981 Erbstoesser
4,291,395 A 9/1981 Holmes
4,303,128 A 12/1981 Marr, Jr.
4,307,204 A 12/1981 Vidal
4,307,653 A 12/1981 Goes et al.
4,323,118 A 4/1982 Bergmann
4,323,991 A 4/1982 Holmes et al.
4,345,650 A 8/1982 Wesley
4,364,232 A 12/1982 Sheinbaum
4,364,587 A 12/1982 Samford
4,385,875 A 5/1983 Kanazawa
4,390,062 A 6/1983 Fox
4,393,928 A 7/1983 Warnock, Sr.
4,396,062 A 8/1983 Iskander
4,418,721 A 12/1983 Holmes
4,433,701 A 2/1984 Cox et al.
4,442,903 A 4/1984 Schutt et al.
4,467,833 A 8/1984 Satterwhite et al.
4,485,780 A 12/1984 Price et al.
4,491,186 A 1/1985 Alder
4,495,990 A 1/1985 Titus et al.
4,518,013 A 5/1985 Lazarus
4,526,667 A 7/1985 Parkhurst et al.
4,527,636 A 7/1985 Bordon
4,557,295 A 12/1985 Holmes
4,562,867 A 1/1986 Stouffer
4,570,675 A 2/1986 Fenwick et al.
4,570,715 A 2/1986 Van Meurs et al.
4,618,197 A 10/1986 White
4,648,455 A 3/1987 Luke
4,716,960 A 1/1988 Eastlund et al.
4,747,451 A 5/1988 Adams, Jr. et al.
4,765,184 A 8/1988 Delatorre
4,801,310 A 1/1989 Bielefeldt
4,805,407 A 2/1989 Buchanan
4,808,084 A 2/1989 Tsubouchi et al.
4,817,863 A 4/1989 Bragg et al.
4,846,224 A 7/1989 Collins, Jr. et al.
4,848,991 A 7/1989 Bielefeldt
4,857,197 A 8/1989 Young et al.
4,895,582 A 1/1990 Bielefeldt
4,911,239 A 3/1990 Winckler et al.
4,919,201 A 4/1990 Bridges et al.
4,919,204 A 4/1990 Baker et al.
4,921,438 A 5/1990 Godfrey et al.
4,930,576 A 6/1990 Berryman et al.
4,938,073 A 7/1990 Stephenson
4,945,995 A 8/1990 Tholance et al.
4,967,048 A 10/1990 Langston
4,974,674 A 12/1990 Wells
4,984,594 A 1/1991 Vinegar et al.
4,989,987 A 2/1991 Berryman et al.
4,998,585 A 3/1991 Newcomer et al.
5,026,168 A 6/1991 Berryman et al.
RE33,690 E 9/1991 Adams, Jr. et al.
5,058,683 A 10/1991 Godfrey et al.
5,076,327 A 12/1991 Mettner
5,080,783 A 1/1992 Brown
5,099,918 A 3/1992 Bridges et al.
5,154,835 A 10/1992 DeMichael
5,165,450 A 11/1992 Marrelli
5,166,677 A 11/1992 Schoenberg
5,184,678 A 2/1993 Pechkov et al.
5,202,194 A 4/1993 VanBerg, Jr.
5,207,273 A 5/1993 Cates et al.
5,207,274 A 5/1993 Streich et al.
5,211,678 A 5/1993 Stephenson et al.
5,228,508 A 7/1993 Facteau et al.
5,251,703 A 10/1993 Skinner
5,265,636 A * 11/1993 Reed ..... 137/14
5,272,920 A 12/1993 Stephenson et al.
5,279,363 A 1/1994 Schultz et al.
5,282,508 A 2/1994 Ellingsen et al.
5,289,877 A 3/1994 Naegele et al.
5,303,782 A 4/1994 Johannessen
5,319,964 A 6/1994 Stephenson et al.
5,320,425 A 6/1994 Stephenson et al.
5,332,035 A 7/1994 Schultz et al.
5,333,684 A 8/1994 Walter et al.
5,335,166 A 8/1994 Stephenson
5,337,808 A 8/1994 Graham
5,337,821 A 8/1994 Peterson
5,338,496 A 8/1994 Talbot et al.
5,341,883 A 8/1994 Ringgenberg
5,343,963 A 9/1994 Bouldin et al.
5,365,435 A 11/1994 Stephenson
5,375,658 A 12/1994 Schultz et al.
5,435,393 A 7/1995 Brekke et al.
5,455,804 A 10/1995 Holmes et al.
5,464,059 A 11/1995 Kristiansen
5,482,117 A 1/1996 Kolpak et al.

(56) References Cited

U.S. PATENT DOCUMENTS

| | | | |
|---|---|---|---|
| 5,484,016 | A | 1/1996 | Surjaatmadja et al. |
| 5,505,262 | A | 4/1996 | Cobb |
| 5,516,603 | A | 5/1996 | Holcombe |
| 5,533,571 | A | 7/1996 | Surjaatmadja et al. |
| 5,547,029 | A | 8/1996 | Rubbo et al. |
| 5,570,744 | A | 11/1996 | Weingarten et al. |
| 5,578,209 | A | 11/1996 | Weiss |
| 5,673,751 | A | 10/1997 | Head et al. |
| 5,730,223 | A | 3/1998 | Restarick |
| 5,803,179 | A | 9/1998 | Echols et al. |
| 5,815,370 | A | 9/1998 | Sutton |
| 5,839,508 | A | 11/1998 | Tubel et al. |
| 5,868,201 | A | 2/1999 | Bussear et al. |
| 5,893,383 | A | 4/1999 | Facteau |
| 5,896,076 | A | 4/1999 | van Namen |
| 5,896,928 | A | 4/1999 | Coon |
| 6,009,951 | A | 1/2000 | Coronado et al. |
| 6,015,011 | A | 1/2000 | Hunter |
| 6,032,733 | A | 3/2000 | Ludwig et al. |
| 6,078,471 | A | 6/2000 | Fiske |
| 6,098,020 | A | 8/2000 | den Boer |
| 6,109,370 | A | 8/2000 | Gray |
| 6,109,372 | A | 8/2000 | Dorel et al. |
| 6,112,815 | A | 9/2000 | Bøe et al. |
| 6,112,817 | A | 9/2000 | Voll et al. |
| 6,164,375 | A | 12/2000 | Carisella |
| 6,176,308 | B1 | 1/2001 | Pearson |
| 6,179,052 | B1 | 1/2001 | Purkis et al. |
| 6,247,536 | B1 | 6/2001 | Leismer et al. |
| 6,253,861 | B1 | 7/2001 | Carmichael et al. |
| 6,305,470 | B1 | 10/2001 | Woie |
| 6,315,043 | B1 | 11/2001 | Farrant et al. |
| 6,315,049 | B1 | 11/2001 | Hickey et al. |
| 6,320,238 | B1 | 11/2001 | Kizilyalli et al. |
| 6,345,963 | B1 | 2/2002 | Thomin et al. |
| 6,367,547 | B1 | 4/2002 | Towers et al. |
| 6,371,210 | B1 | 4/2002 | Bode et al. |
| 6,397,950 | B1 | 6/2002 | Streich et al. |
| 6,426,917 | B1 | 7/2002 | Tabanou et al. |
| 6,431,282 | B1 | 8/2002 | Bosma et al. |
| 6,433,991 | B1 | 8/2002 | Deaton et al. |
| 6,450,263 | B1 | 9/2002 | Schwendemann |
| 6,464,011 | B2 | 10/2002 | Tubel |
| 6,470,970 | B1 | 10/2002 | Purkis et al. |
| 6,478,091 | B1 | 11/2002 | Gano |
| 6,497,252 | B1 | 12/2002 | K•hler et al. |
| 6,505,682 | B2 | 1/2003 | Brockman |
| 6,516,888 | B1 | 2/2003 | Gunnarson et al. |
| 6,540,263 | B1 | 4/2003 | Sausner |
| 6,544,691 | B1 | 4/2003 | Guidotti |
| 6,547,010 | B2 | 4/2003 | Hensley et al. |
| 6,567,013 | B1 | 5/2003 | Purkis et al. |
| 6,575,237 | B2 | 6/2003 | Purkis et al. |
| 6,575,248 | B2 | 6/2003 | Zhang et al. |
| 6,585,051 | B2 | 7/2003 | Purkis et al. |
| 6,589,027 | B2 | 7/2003 | Ursan et al. |
| 6,622,794 | B2 | 9/2003 | Zisk, Jr. |
| 6,627,081 | B1 | 9/2003 | Hilditch et al. |
| 6,644,412 | B2 | 11/2003 | Bode et al. |
| 6,668,936 | B2 | 12/2003 | Williamson, Jr. et al. |
| 6,672,382 | B2 | 1/2004 | Schultz et al. |
| 6,679,324 | B2 | 1/2004 | Den Boer et al. |
| 6,679,332 | B2 | 1/2004 | Vinegar et al. |
| 6,691,781 | B2 | 2/2004 | Grant et al. |
| 6,695,067 | B2 | 2/2004 | Johnson et al. |
| 6,705,085 | B1 | 3/2004 | Braithwaite et al. |
| 6,708,763 | B2 | 3/2004 | Howard et al. |
| 6,719,048 | B1 | 4/2004 | Ramos et al. |
| 6,719,051 | B2 | 4/2004 | Hailey, Jr. et al. |
| 6,724,687 | B1 | 4/2004 | Stephenson et al. |
| 6,725,925 | B2 | 4/2004 | Al-Ramadhan |
| 6,742,441 | B1 | 6/2004 | Surjaatmadja et al. |
| 6,757,243 | B1 | 6/2004 | Chaudhuri et al. |
| 6,769,498 | B2 | 8/2004 | Hughes |
| 6,786,285 | B2 | 9/2004 | Johnson et al. |
| 6,812,811 | B2 | 11/2004 | Robison et al. |
| 6,817,416 | B2 | 11/2004 | Wilson et al. |
| 6,834,725 | B2 | 12/2004 | Whanger et al. |
| 6,840,325 | B2 | 1/2005 | Stephenson |
| 6,851,473 | B2 | 2/2005 | Davidson |
| 6,851,560 | B2 | 2/2005 | Reig et al. |
| 6,857,475 | B2 | 2/2005 | Johnson |
| 6,857,476 | B2 | 2/2005 | Richards |
| 6,859,740 | B2 | 2/2005 | Stephenson et al. |
| 6,886,634 | B2 | 5/2005 | Richards |
| 6,907,937 | B2 | 6/2005 | Whanger et al. |
| 6,913,079 | B2 | 7/2005 | Tubel |
| 6,935,432 | B2 | 8/2005 | Nguyen |
| 6,957,703 | B2 | 10/2005 | Trott et al. |
| 6,958,704 | B2 | 10/2005 | Vinegar et al. |
| 6,959,609 | B2 | 11/2005 | Stephenson |
| 6,967,589 | B1 | 11/2005 | Peters |
| 6,976,507 | B1 | 12/2005 | Webb et al. |
| 7,007,756 | B2 | 3/2006 | Lerche et al. |
| 7,011,101 | B2 | 3/2006 | Bowe et al. |
| 7,011,152 | B2 | 3/2006 | Soelvik |
| 7,013,979 | B2 | 3/2006 | Richard |
| 7,017,662 | B2 | 3/2006 | Schultz et al. |
| 7,025,134 | B2 | 4/2006 | Byrd et al. |
| 7,038,332 | B2 | 5/2006 | Robison et al. |
| 7,040,391 | B2 | 5/2006 | Leuthen et al. |
| 7,043,937 | B2 | 5/2006 | Lifson et al. |
| 7,059,401 | B2 | 6/2006 | Bode et al. |
| 7,063,162 | B2 | 6/2006 | Daling et al. |
| 7,066,261 | B2 | 6/2006 | Vicente et al. |
| 7,096,945 | B2 | 8/2006 | Richards et al. |
| 7,097,764 | B2 | 8/2006 | Neofotistos |
| 7,100,686 | B2 | 9/2006 | Wittrisch |
| 7,100,688 | B2 | 9/2006 | Stephenson et al. |
| 7,108,083 | B2 | 9/2006 | Simonds et al. |
| 7,114,560 | B2 | 10/2006 | Nguyen et al. |
| 7,143,832 | B2 | 12/2006 | Freyer |
| 7,168,494 | B2 | 1/2007 | Starr et al. |
| 7,185,706 | B2 | 3/2007 | Freyer |
| 7,199,480 | B2 | 4/2007 | Fripp et al. |
| 7,207,386 | B2 | 4/2007 | Brannon et al. |
| 7,213,650 | B2 | 5/2007 | Lehman et al. |
| 7,213,681 | B2 | 5/2007 | Birchak et al. |
| 7,216,738 | B2 | 5/2007 | Birchak et al. |
| 7,258,169 | B2 | 8/2007 | Fripp et al. |
| 7,290,606 | B2 | 11/2007 | Coronado et al. |
| 7,296,633 | B2 | 11/2007 | Bode et al. |
| 7,318,471 | B2 | 1/2008 | Rodney et al. |
| 7,322,409 | B2 | 1/2008 | Wittle et al. |
| 7,322,416 | B2 | 1/2008 | Burris, II et al. |
| 7,350,577 | B2 | 4/2008 | Howard et al. |
| 7,353,875 | B2 | 4/2008 | Stephenson et al. |
| 7,363,967 | B2 | 4/2008 | Burris, II et al. |
| 7,404,416 | B2 | 7/2008 | Schultz et al. |
| 7,405,998 | B2 | 7/2008 | Webb et al. |
| 7,409,901 | B2 | 8/2008 | Lucas et al. |
| 7,409,999 | B2 | 8/2008 | Henriksen et al. |
| 7,413,010 | B2 | 8/2008 | Blauch et al. |
| 7,419,002 | B2 | 9/2008 | Dybevik et al. |
| 7,426,962 | B2 | 9/2008 | Moen et al. |
| 7,440,283 | B1 | 10/2008 | Rafie |
| 7,455,104 | B2 | 11/2008 | Duhon et al. |
| 7,455,115 | B2 | 11/2008 | Loretz et al. |
| 7,464,609 | B2 | 12/2008 | Fallet |
| 7,468,890 | B2 | 12/2008 | Lin |
| 7,469,743 | B2 | 12/2008 | Richards |
| 7,520,321 | B2 | 4/2009 | Hiron et al. |
| 7,537,056 | B2 | 5/2009 | MacDougall |
| 7,578,343 | B2 | 8/2009 | Augustine |
| 7,591,343 | B2 | 9/2009 | Han et al. |
| 7,621,336 | B2 | 11/2009 | Badalamenti et al. |
| 7,635,328 | B2 | 12/2009 | Hinman et al. |
| 7,640,990 | B2 | 1/2010 | Ross et al. |
| 7,644,773 | B2 | 1/2010 | Richard |
| 7,686,078 | B2 | 3/2010 | Khomynets |
| 7,699,102 | B2 | 4/2010 | Storm et al. |
| 7,708,068 | B2 | 5/2010 | Hailey, Jr. |
| 7,712,540 | B2 | 5/2010 | Loretz et al. |
| 7,780,152 | B2 | 8/2010 | Rao |

(56) References Cited

U.S. PATENT DOCUMENTS

| | | | |
|---|---|---|---|
| 7,789,145 | B2 | 9/2010 | Patel |
| 7,802,621 | B2 | 9/2010 | Richards et al. |
| 7,814,968 | B2 | 10/2010 | Bizon |
| 7,814,973 | B2 | 10/2010 | Dusterhoft et al. |
| 7,825,771 | B2 | 11/2010 | Bhogal et al. |
| 7,828,067 | B2 | 11/2010 | Scott et al. |
| 7,832,473 | B2 | 11/2010 | Pensgaard |
| 7,849,925 | B2 | 12/2010 | Patel |
| 7,849,930 | B2 | 12/2010 | Chalker et al. |
| 7,857,050 | B2 | 12/2010 | Zazovsky et al. |
| 7,857,061 | B2 | 12/2010 | Richards |
| 7,870,906 | B2 | 1/2011 | Ali |
| 7,882,894 | B2 | 2/2011 | Nguyen et al. |
| 7,905,228 | B2 | 3/2011 | Blacker et al. |
| 7,909,088 | B2 | 3/2011 | O'Malley et al. |
| 7,909,089 | B2 | 3/2011 | Jackson |
| 7,909,094 | B2 | 3/2011 | Schultz et al. |
| 7,918,272 | B2 | 4/2011 | Gaudette et al. |
| 7,918,275 | B2 | 4/2011 | Clem |
| 7,967,074 | B2 | 6/2011 | Lake et al. |
| 7,980,265 | B2 | 7/2011 | Holmes et al. |
| 8,011,438 | B2 | 9/2011 | Edwards et al. |
| 8,016,030 | B1 | 9/2011 | Prado Garcia |
| 8,025,103 | B1 | 9/2011 | Wolinsky |
| 8,069,921 | B2 | 12/2011 | Garcia et al. |
| 8,069,923 | B2 | 12/2011 | Blanco et al. |
| 8,070,424 | B2 | 12/2011 | Priestman et al. |
| 8,083,935 | B2 | 12/2011 | Eia |
| 8,127,856 | B1 | 3/2012 | Nish et al. |
| 8,184,007 | B2 | 5/2012 | Ishikawa |
| 8,191,627 | B2 | 6/2012 | Hamid et al. |
| 8,196,665 | B2 | 6/2012 | Wolinsky |
| 8,235,103 | B2 | 8/2012 | Wright et al. |
| 8,235,118 | B2 | 8/2012 | Schultz et al. |
| 8,235,128 | B2 | 8/2012 | Dykstra et al. |
| 8,261,839 | B2 | 9/2012 | Fripp et al. |
| 8,272,443 | B2 | 9/2012 | Watson et al. |
| 8,276,669 | B2 | 10/2012 | Dykstra et al. |
| 8,289,249 | B2 | 10/2012 | Lee |
| 8,291,976 | B2 | 10/2012 | Schultz et al. |
| 8,291,979 | B2 | 10/2012 | Oddie |
| 8,302,696 | B2 | 11/2012 | Williams et al. |
| 8,322,426 | B2 | 12/2012 | Wright et al. |
| 8,327,885 | B2 | 12/2012 | Dykstra et al. |
| 8,347,957 | B2 | 1/2013 | Stephenson et al. |
| 8,356,668 | B2 | 1/2013 | Dykstra et al. |
| 8,376,047 | B2 | 2/2013 | Dykstra et al. |
| 8,381,816 | B2 | 2/2013 | Leduc et al. |
| 8,387,662 | B2 | 3/2013 | Dykstra et al. |
| 8,403,038 | B2 | 3/2013 | Russell et al. |
| 8,430,130 | B2 | 4/2013 | Dykstra |
| 8,439,116 | B2 | 5/2013 | East, Jr. et al. |
| 8,453,736 | B2 | 6/2013 | Constantine |
| 8,453,746 | B2 | 6/2013 | Hailey, Jr. et al. |
| 8,454,579 | B2 | 6/2013 | Fangrow, Jr. |
| 8,464,759 | B2 | 6/2013 | Dykstra |
| 8,466,860 | B2 | 6/2013 | Naka et al. |
| 8,474,535 | B2 | 7/2013 | Richards et al. |
| 8,506,813 | B2 | 8/2013 | Alspektor |
| 8,543,245 | B2 | 9/2013 | Heitman et al. |
| 8,544,548 | B2 | 10/2013 | Coronado et al. |
| 8,555,924 | B2 | 10/2013 | Faram et al. |
| 8,555,975 | B2 | 10/2013 | Dykstra et al. |
| 8,584,747 | B2 | 11/2013 | Eslinger |
| 8,602,106 | B2 | 12/2013 | Lopez |
| 8,606,521 | B2 | 12/2013 | Beisel et al. |
| 8,607,854 | B2 | 12/2013 | Yang |
| 8,616,283 | B2 | 12/2013 | McKeen et al. |
| 2005/0110217 | A1 | 5/2005 | Wood et al. |
| 2007/0028977 | A1 | 2/2007 | Goulet |
| 2007/0193752 | A1 | 8/2007 | Kim |
| 2007/0246263 | A1* | 10/2007 | Reitsma ..... E21B 21/06 175/38 |
| 2007/0256828 | A1 | 11/2007 | Birchak et al. |
| 2007/0257405 | A1 | 11/2007 | Freyer |
| 2008/0035330 | A1 | 2/2008 | Richards |
| 2008/0041580 | A1 | 2/2008 | Freyer et al. |
| 2008/0041581 | A1 | 2/2008 | Richards |
| 2008/0041582 | A1 | 2/2008 | Saetre et al. |
| 2008/0041588 | A1 | 2/2008 | Richards et al. |
| 2008/0251255 | A1 | 10/2008 | Forbes et al. |
| 2008/0261295 | A1 | 10/2008 | Butler et al. |
| 2008/0283238 | A1 | 11/2008 | Richards et al. |
| 2009/0000787 | A1 | 1/2009 | Hill et al. |
| 2009/0009297 | A1 | 1/2009 | Shinohara et al. |
| 2009/0009412 | A1 | 1/2009 | Warther |
| 2009/0009437 | A1 | 1/2009 | Hwang et al. |
| 2009/0041588 | A1 | 2/2009 | Hunter et al. |
| 2009/0101344 | A1 | 4/2009 | Crow et al. |
| 2009/0101354 | A1 | 4/2009 | Holmes et al. |
| 2009/0114395 | A1 | 5/2009 | Holmes et al. |
| 2009/0120647 | A1 | 5/2009 | Turick et al. |
| 2009/0159282 | A1 | 6/2009 | Webb et al. |
| 2009/0205831 | A1 | 8/2009 | Jacob |
| 2009/0218103 | A1 | 9/2009 | Aakre et al. |
| 2009/0236102 | A1 | 9/2009 | Guest et al. |
| 2009/0250224 | A1 | 10/2009 | Wright et al. |
| 2009/0277650 | A1 | 11/2009 | Casciaro et al. |
| 2009/0301730 | A1 | 12/2009 | Gweily |
| 2010/0300683 | A1 | 12/2010 | Looper et al. |
| 2010/0310384 | A1 | 12/2010 | Stephenson et al. |
| 2011/0042092 | A1* | 2/2011 | Fripp et al. ..... 166/319 |
| 2011/0042323 | A1 | 2/2011 | Sullivan, II |
| 2011/0139453 | A1* | 6/2011 | Schultz et al. ..... 166/272.3 |
| 2011/0186300 | A1* | 8/2011 | Dykstra et al. ..... 166/316 |
| 2011/0198097 | A1 | 8/2011 | Moen |
| 2011/0203671 | A1 | 8/2011 | Doig |
| 2011/0266001 | A1 | 11/2011 | Dykstra et al. |
| 2011/0308806 | A9 | 12/2011 | Dykstra et al. |
| 2012/0061088 | A1 | 3/2012 | Dykstra et al. |
| 2012/0111577 | A1 | 5/2012 | Dykstra et al. |
| 2012/0125120 | A1 | 5/2012 | Dykstra |
| 2012/0211243 | A1 | 8/2012 | Dykstra et al. |
| 2012/0234557 | A1 | 9/2012 | Dykstra et al. |
| 2012/0255739 | A1 | 10/2012 | Fripp et al. |
| 2012/0255740 | A1 | 10/2012 | Fripp et al. |
| 2012/0305243 | A1 | 12/2012 | Hallundbæk et al. |
| 2013/0020088 | A1 | 1/2013 | Dyer et al. |
| 2013/0075107 | A1 | 3/2013 | Dykstra et al. |
| 2013/0255960 | A1 | 10/2013 | Fripp et al. |

FOREIGN PATENT DOCUMENTS

| | | | |
|---|---|---|---|
| EP | 1857633 | A2 | 11/2007 |
| EP | 2383430 | A2 | 11/2011 |
| EP | 2672059 | A1 | 12/2013 |
| GB | 2314866 | A | 1/1998 |
| GB | 2341405 | A | 3/2000 |
| GB | 2356879 | A | 6/2001 |
| GB | 2371578 | A | 7/2002 |
| WO | 0063530 | A1 | 10/2000 |
| WO | 0214647 | A1 | 2/2002 |
| WO | 02059452 | A1 | 8/2002 |
| WO | 02075110 | A1 | 9/2002 |
| WO | 02090714 | A1 | 11/2002 |
| WO | 03062597 | A1 | 7/2003 |
| WO | 2004012040 | A2 | 2/2004 |
| WO | 2004057715 | A2 | 7/2004 |
| WO | 2004081335 | A2 | 9/2004 |
| WO | 2005090741 | A1 | 9/2005 |
| WO | 2005116394 | A1 | 12/2005 |
| WO | 2006003112 | A1 | 1/2006 |
| WO | 2006003113 | A1 | 1/2006 |
| WO | 2006015277 | A1 | 2/2006 |
| WO | 2008024645 | A2 | 2/2008 |
| WO | 2008024645 | A3 | 2/2008 |
| WO | 2008053364 | A2 | 5/2008 |
| WO | 2008053364 | A3 | 5/2008 |
| WO | 2009048822 | A2 | 4/2009 |
| WO | 2009048823 | A2 | 4/2009 |
| WO | 2009052076 | A2 | 4/2009 |
| WO | 2009052103 | A2 | 4/2009 |
| WO | 2009052149 | A2 | 4/2009 |
| WO | 2009067021 | A2 | 5/2009 |

(56) References Cited

FOREIGN PATENT DOCUMENTS

| | | | |
|---|---|---|---|
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |
| WO | 2010030266 | A1 | 3/2010 |
| WO | 2010030422 | A1 | 3/2010 |
| WO | 2010030422 | A9 | 3/2010 |
| WO | 2010030423 | A1 | 3/2010 |
| WO | 2011002615 | A2 | 1/2011 |
| WO | 2011041674 | A2 | 4/2011 |
| WO | 2012138681 | A2 | 10/2012 |
| WO | 2012138681 | A3 | 10/2012 |

OTHER PUBLICATIONS

"Apparatus and Method of Inducing Fluidic Oscillation in a Rotating Cleaning Nozzle," ip.com, dated Apr. 24, 2007, 3 pages.
Foreign communication from a counterpart application—Canadian Office Action, Application No. 2,737,998, Jun. 21, 2013, 3 pages.
Fripp, Michael, et al., "Development of a High-Temperature Rechargeable Battery for Downhole Use in the Petroleum Industry," OTC 19621, 2008, 8 pages, Offshore Technology Conference.
The Lee Company brochure entitled "Flosert—Constant Flow Rate," Dec. 2002, 1 page.
The Lee Company Technical Center, "Technical Hydraulic Handbook," 11th Edition, © 1971-2009, 7 pages.
Savkar, Sudhir D., Dissertation, "An Experimental Study of Switching in a Bistable Fluid Amplifier," The University of Michigan Industry Program of the College of Engineering, Dec. 1966, 137 pages.
Takebayashi, Masahiro, et al., International Compressor Engineering Conference, Paper 597, "Discharge Characteristics of an Oil Feeder Pump Using Nozzle Type Fluidic Diodes for a Horizontal Compressor Depending on the Driving Speed," 1988, pp. 19-26 plus 1 cover page, Purdue University.
Wright, Perry, et al., "The Development and Application of HT/HP Fiber-Optic Connectors for Use on Subsea Intelligent Wells," OTC 15323, 2003, pp. 1-8, Offshore Technology Conference.
Angrist, Stanley W., "Fluid Control Devices," Scientific American, Dec. 1964, pp. 80-88.
Crow, S. L., et al., "Means for Passive Inflow Control Upon Gas Breakthrough," SPE 102208, 2006, pp. 1-6, Society of Petroleum Engineers.
Filing receipt and specification for patent application entitled "Method and Apparatus for Autonomous Downhole Fluid Selection with Vortex Assembly," by Michael Linley Fripp, et al., filed Aug. 18, 2009 as U.S. Appl. No. 12/542,695.
Filing receipt and patent application entitled "Fast Pressure Protection System and Method," by Stanley V. Stephenson, et al., filed Dec. 3, 2012 as U.S. Appl. No. 13/692,833.
"Fluidics," Microsoft® Encarta® Online Encyclopedia 2009, http://encarta.msn.com/text_761578292__1/Fluidics.html, 1 page, downloaded from website on Aug. 13, 2009, © 1993-2009 by Microsoft Corporation.
Foreign communication from a counterpart application—Australian Examination Report, AU 2007315792, Mar. 31, 2010, 1 page.
Foreign communication from a counterpart application—Chinese Office Action, CN 200580016654.2, Feb. 27, 2009, 6 pages.
Foreign communication from a counterpart application—European Search Report, EP 11164202.1, Dec. 7, 2011, 6 pages.
Foreign communication from a counterpart application—United Kingdom Search Report, GB 0707831.4, Jul. 19, 2007, 3 pages.
Foreign communication from a counterpart application—International Search Report, PCT/NO02/00158, Aug. 28, 2002, 2 pages.
Foreign communication from a counterpart application—International Preliminary Examination Report, PCT/NO02/00158, Jul. 2, 2003, 3 pages.
Foreign communication from a counterpart application—International Search Report and Written Opinion, PCT/US07175743, Feb. 11, 2008, 4 pages.
Foreign communication from a counterpart application—International Preliminary Report on Patentability, Feb. 24, 2009, PCT/US07/75743, 4 pages.
Foreign communication from a counterpart application—International Search Report and Written Opinion, Feb. 27, 2009, PCT/IB07/04287, 4 pages.
Foreign communication from a counterpart application—International Preliminary Report on Patentability, Jul. 28, 2009, PCT/IB2007/004287, 4 pages.
Foreign communication from a related counterpart application—International Search Report and Written Opinion, PCT/US2010/059121, Oct. 13, 2011, 10 pages.
Foreign communication from a counterpart application—International Preliminary Report on Patentability, Jun. 12, 2012, PCT/US2010/059121, 7 pages.
Foreign communication from a related counterpart application—International Search Report and Written Opinion, Oct. 29, 2012, PCT/US2012/032044, 9 pages.
Foreign communication from a related counterpart application—International Preliminary Report on Patentability, Oct. 8, 2013, PCT/US2012/032044, 6 pages.
Freyer, Rune, et al. "An Oil Selective Inflow Control System," SPE 78272, 2002, pp. 1-8, Society of Petroleum Engineers Inc.
Gebben, Vernon D., "Vortex Valve Performance Power Index," NASA TM X-52257, May 1967, pp. 1-14 plus 2 cover pages and Figures 1-8, National Aeronautics and Space Administration.
Haakh, Dr.-Ing. Frieder, "Vortex chamber diodes as throttle devices in pipe systems. Computation of transient flow," 2003, pp. 53-59, vol. 41, No. 1, Journal of Hydraulic Research.
Holmes, Allen B., et al., "A Fluidic Approach to the Design of a Mud Pulser for Bore-Hole Telemetry While Drilling," Technical Memorandum, DRCMS Code: 7-36AA-7100, HDL Project: A54735, Aug. 1979, pp. 1, 2, 5, 6, 9-27, and 29-37, Department of the Interior, U.S. Geological Survey, Washington, D.C.
Kirshner, Joseph M., et al., "Design Theory of Fluidic Components", 1975, pp. 276-283, 382-389, plus cover page, Academic Press, A Subsidiary of Harcourt Brace Jovanovich, Publishers.
Kirshner, Joseph M., "Fluid Amplifiers," pp. 187-193, 228, 229, plus cover page, McGraw-Hill Book Company.
"Lee Restrictor Selector," Product Brochure, Jan. 2011, 9 pages, The Lee Company, USA.
Lindeburg, Michael R., "Mechanical Engineering Reference Manual for the PE Exam," Twelfth Edition, 2006, pp. 17-16 to 17-17 plus 2 pages cover and publishing information, Professional Publications, Inc.
NuVision product profile entitled "Vortex Diode Pumps: No Moving Part Pumping Systems," 2 pages, NuVision Engineering.
Office Action dated Oct. 29, 2012 (42 pages), U.S. Appl. No. 12/700,685, filed Feb. 4, 2010.
Office Action (Final) dated Jul. 1, 2013 (38 pages), U.S. Appl. No. 12/700,685, filed Feb. 4, 2010.
Office Action dated Dec. 26, 2013 (47 pages), U.S. Appl. No. 12/700,685, filed Feb. 4, 2010.
Tesař, V., "Fluidic Valve for Reactor Regeneration Flow Switching," Chemical Engineering Research and Design, Trans IChemE, Part A, pp. 398-408, Mar. 2004, vol. 82, No. A3, Institution of Chemical Engineers.
Tesař, V., "Fluidic Valves for Variable-Configuration Gas Treatment," Chemical Engineering Research and Design, Trans IChemE, Part A, pp. 1111-1121, Sep. 2005, vol. 83, No. A9, Institution of Chemical Engineers.
Tesař, Václav, et al., "New Ways of Fluid Flow Control in Automobiles: Experience with Exhaust Gas Aftertreatment Control," F2000H192, FISITA World Automotive Congress, Jun. 12-15, 2000, Seoul, Korea, pp. 1-8.
Tesař, V., "Sampling by Fluidics and Microfluidics," Acta Polytechnica, 2002, pp. 41-49, vol. 42, No. 2/2002, Czech Technical University Publishing House.

(56) References Cited

OTHER PUBLICATIONS

Weatherford product brochure entitled, "Application Answers—Combating Coning by Creating Even Flow Distribution in Horizontal Sand-Control Completions," 2005, 4 pages, Weatherford International Ltd.
Willingham, J. D., et al., "Perforation Friction Pressure of Fracturing Fluid Slurries," SPE 25891, 1993, pp. 479-491 plus 1 page corrected drawing, Society of Petroleum Engineers, Inc.
Foreign communication from a related counterpart application—European Search Report, EP 13182098.7, Nov. 13, 2013, 7 pages.

* cited by examiner

WELLHEAD FLOWBACK CONTROL SYSTEM AND METHOD

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations that contain hydrocarbons to allow for the recovery of the hydrocarbons. Once the wellbore has been drilled, various servicing and/or completion operations may be performed to configure the wellbore for the production of hydrocarbons. During drilling operations, servicing operations, completion operations, or combinations thereof, large volumes of often very high pressure fluids may be present within the wellbore and/or subterranean formation and/or within various flowlines connecting wellbore servicing equipment components to the wellbore. As such, the opportunity for an uncontrolled discharge of fluids, whether as a result of operator error, equipment failure, or some other unforeseen circumstance, exists in a wellsite environment. The uncontrolled discharge of fluids from the wellbore, whether directly from the wellhead or from a flowline in connection therewith, poses substantial safety risks to personnel. As such, there is a need for dealing with such uncontrolled fluid discharges.

SUMMARY

Disclosed herein is a wellbore servicing system disposed at a wellbore, the wellbore servicing system comprising at least one wellbore servicing equipment component, wherein a flow path extends from the wellbore servicing system component into the wellbore, and a flow-back control system, wherein the flow-back control system is disposed along the flow path, and wherein the flow-back control system is configured to allow fluid communication via the flow path in a first direction at not less than a first rate and to allow fluid communication via the flow path in a second direction at not more than a second rate, wherein the first rate is greater than the second rate.

Also disclosed herein is a wellbore servicing method comprising providing a flow path between a wellbore servicing system and a wellbore penetrating a subterranean formation, wherein a flow-back control system comprising a fluidic diode is disposed along the flow path at the surface of the subterranean formation, and communicating a fluid via the flow path in a first direction at not less than a first rate.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
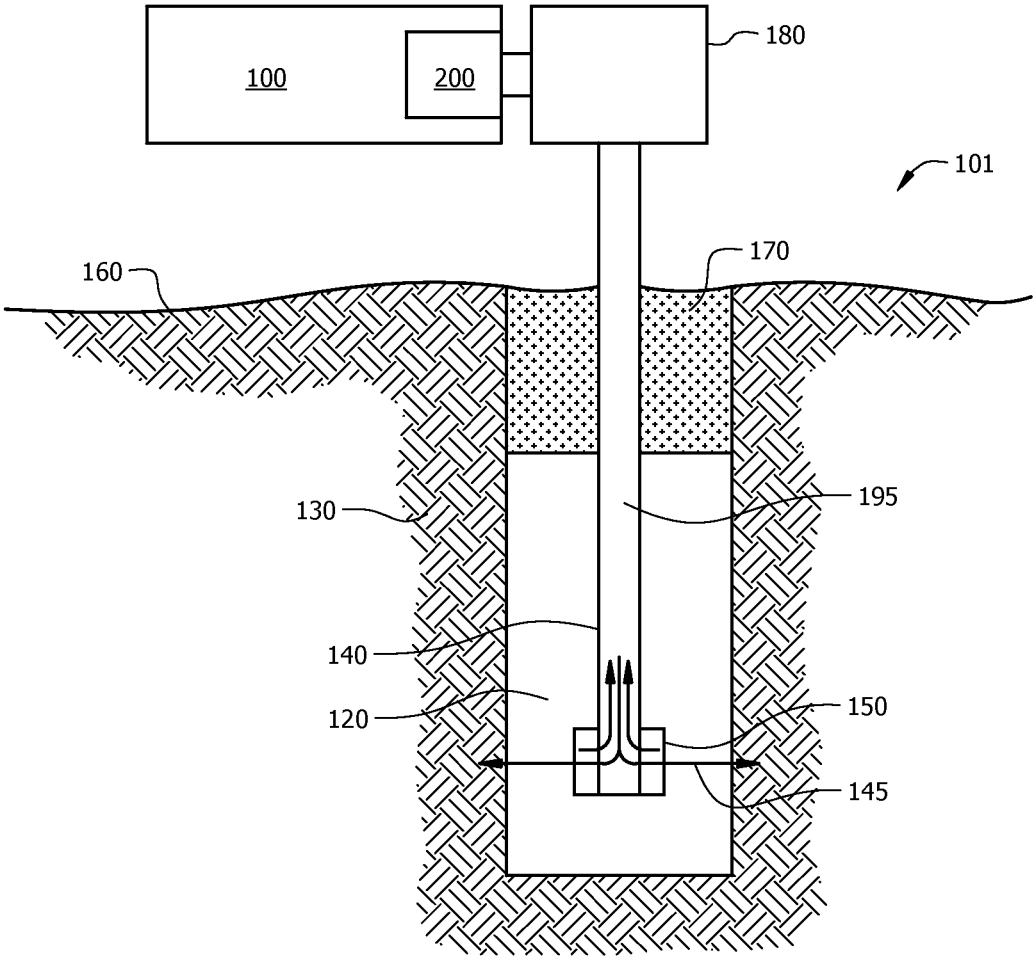
FIG. 1 is a partial cutaway view of an operating environment of a flow-back control system.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," or "upward," meaning toward the surface of the wellbore and with "down," "lower," or "downward," meaning toward the terminal end of the well, regardless of the wellbore orientation. Reference to in or out will be made for purposes of description with "in," "inner," or "inward" meaning toward the center or central axis of the wellbore and/or an element, and with "out," "outer," or "outward" away from the center or central axis of the wellbore and/or an element. Reference to "longitudinal," "longitudinally," or "axially" means a direction substantially aligned with the main axis of the wellbore, a wellbore tubular, or an element. Reference to "radial" or "radially" means a direction substantially aligned with a line from the main axis of the wellbore, a wellbore tubular, and/or an element generally outward. The various characteristics mentioned above, as well as other features and characteristics described in more detail below, will be readily apparent to those skilled in the art with the aid of this disclosure upon reading the following detailed description of the embodiments, and by referring to the accompanying drawings.

Disclosed herein are embodiments of devices, systems, and methods at least partially controlling the discharge of fluid from a wellbore and/or a component fluidicly connected to the wellbore. Particularly, disclosed herein are one or more embodiments of a flow-back control system, wellbore servicing systems including such a flow-back control system, and methods of utilizing the same.

FIG. 1 schematically illustrates an embodiment of a wellsite 101. In the embodiment of FIG. 1, a wellbore servicing system 100 is deployed at the wellsite 101 and is fluidly coupled to a wellbore 120. The wellbore 120 penetrates a subterranean formation 130, for example, for the purpose of recovering hydrocarbons, storing hydrocarbons, disposing of carbon dioxide, or the like. The wellbore 120 may be drilled into the subterranean formation 130 using any suitable drilling technique. In an embodiment, a drilling or servicing rig may be present at the wellsite 101 and may comprise a derrick with a rig floor through which a pipe string 140 (e.g., a casing string, production string, work string, drill string, segmented tubing, coiled tubing, etc., or combinations thereof) may be lowered into the wellbore 120. The drilling or servicing rig may be conventional and may comprise a motor driven winch and other associated equipment for lowering the pipe string 140 into the wellbore 120. Alternatively, a mobile workover rig, a wellbore servicing unit (e.g., coiled tubing units), or the like may be used to lower the pipe string 140 into the wellbore 120.

The wellbore 120 may extend substantially vertically away from the earth's surface 160 over a vertical wellbore portion, or may deviate at any angle from the earth's surface 160 over a deviated or horizontal wellbore portion. Alternatively, portions or substantially all of the wellbore 120 may be vertical, deviated, horizontal, and/or curved. In some instances, a portion of the pipe string 140 may be secured into position within the wellbore 120 in a conventional manner using cement 170; alternatively, the pipe string 140 may be partially cemented in wellbore 120; alternatively, the pipe string 140 may be uncemented in the wellbore 120; alternatively, all or a portion of the pipe string 140 may be secured using one or more packers (e.g. mechanical or swellable packers, such as SWELLPACKER isolation systems, commercially available from Halliburton Energy Services). In an embodiment, the pipe string 140 may comprise two or more concentrically positioned strings of pipe (e.g., a first pipe string such as jointed pipe or coiled tubing may be positioned within a second pipe string such as casing cemented within the wellbore). It is noted that although one or more of the figures may exemplify a given operating environment, the principles of the devices, systems, and methods disclosed may be similarly applicable in other operational environments, such as offshore and/or subsea wellbore applications.

In the embodiment of FIG. 1, a wellbore servicing apparatus 150 configured for one or more wellbore servicing and/or production operations may be integrated within (e.g., in fluid communication with) the pipe string 140. The wellbore servicing apparatus 150 may be configured to perform one or more servicing operations, for example, fracturing the formation 130, hydrajetting and/or perforating casing (when present) and/or the formation 130, expanding or extending a fluid path through or into the subterranean formation 130, producing hydrocarbons from the formation 130, various other servicing operations, or combinations thereof. In an embodiment, the wellbore servicing apparatus 150 may comprise one or more ports, apertures, nozzles, jets, windows, or combinations thereof for the communication of fluid from a flowbore of the pipe string 140 to the subterranean formation 130 or vice versa. In an embodiment, the wellbore servicing apparatus 150 may be selectively configurable to provide a route of fluid communication between the wellbore servicing apparatus 150 and the wellbore 120, the subterranean formation 130, or combinations thereof. In an embodiment, the wellbore servicing apparatus 150 may be configurable for the performance of multiple servicing operations. In an embodiment, additional downhole tools, for example, one or more isolation devices (for example, a packer, such as a swellable or mechanical packer), may be included within and/or integrated within the wellbore servicing apparatus 150 and/or the pipe string 140, for example a packer located above and/or below wellbore servicing apparatus 150.

Figure 2:
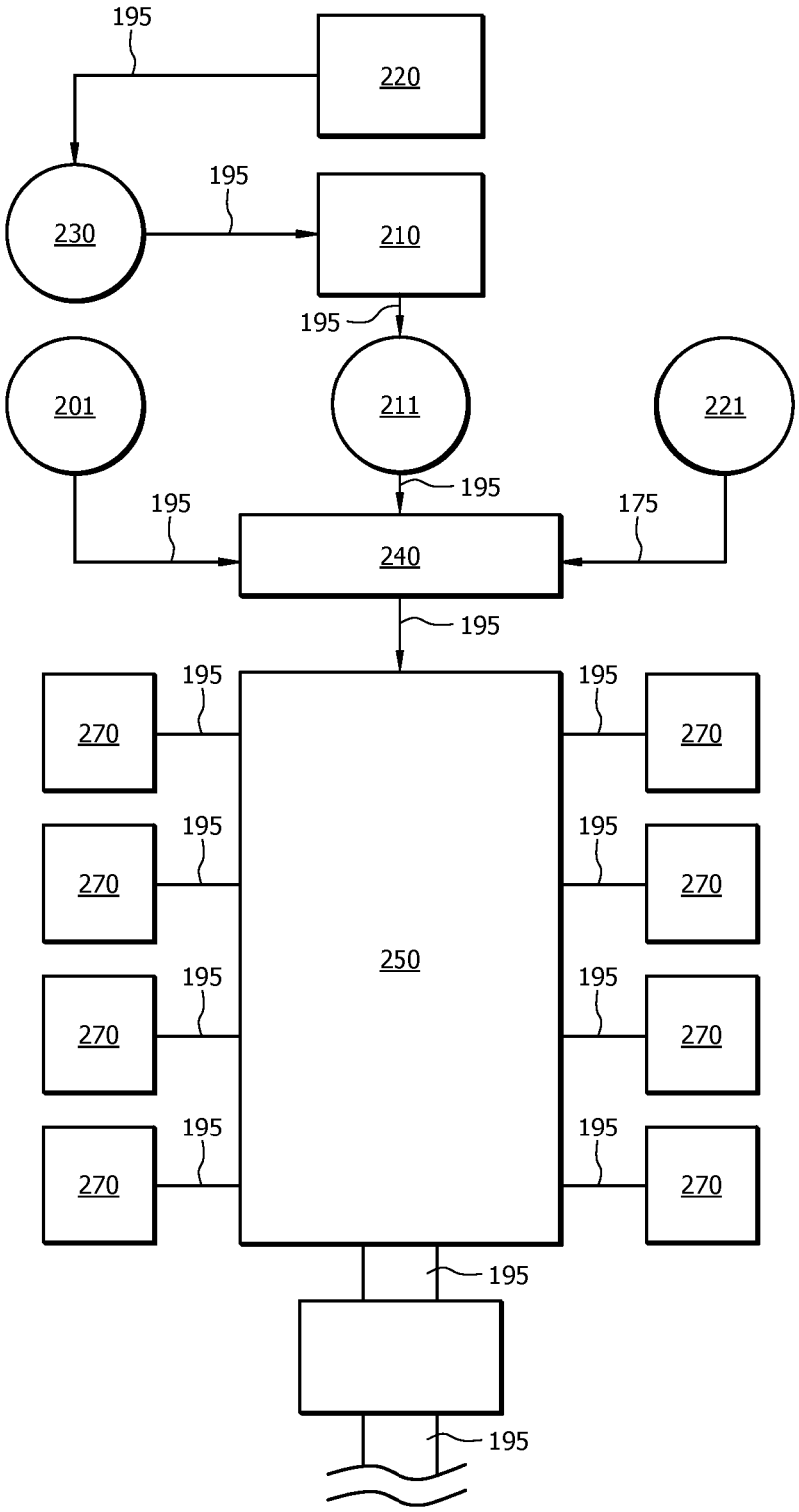
FIG. 2 is a schematic illustration of a wellbore servicing system.

In an embodiment, the wellbore servicing system 100 is generally configured to communicate (e.g., introduce) a fluid (e.g., a wellbore servicing fluid) into wellbore 120, for example, at a rate and pressure suitable for the performance of a desired wellbore servicing operation. In an embodiment, the wellbore servicing system 100 comprises at least one wellbore servicing system equipment component. Turning to FIG. 2, an embodiment of the wellbore servicing system 100 is illustrated. In the embodiment of FIG. 2, the wellbore servicing system 100 may comprise a fluid treatment system 210, a water source 220, one or more storage vessels (such as storage vessels 230, 201, 211, and 221), a blender 240, a wellbore servicing manifold 250, one or more high pressure pumps 270, or combinations thereof. In the embodiment of FIG. 2, the fluid treatment system 210 may obtain water, either directly or indirectly, from the water source 220. Water from the fluid treatment system 210 may be introduced, either directly or indirectly, into the blender 240 where the water is mixed with various other components and/or additives to form the wellbore servicing fluid or a component thereof (e.g., a concentrated wellbore servicing fluid component).

Returning to FIG. 1, in an embodiment, the wellbore servicing system 100 may be fluidicly connected to a wellhead 180, and the wellhead 180 may be connected to the pipe string 140. In various embodiments, the pipe string 140 may comprise a casing string, production string, work string, drill string, a segmented tubing string, a coiled tubing string, a liner, or any combinations thereof. The pipe string 140 may extend from the earth's surface 160 downward within the wellbore 120 to a predetermined or desirable depth, for example, such that the wellbore servicing apparatus 150 is positioned substantially proximate to a portion of the subterranean formation 130 to be serviced (e.g., into which a fracture is to be introduced) and/or produced.

In an embodiment, for example, in the embodiment of FIGS. 1 and 2, a flow path formed by a plurality of fluidicly coupled conduits, collectively referred to as flow path 195, may extend through at least a portion of the wellbore servicing system 100, for example, thereby providing a route of fluid communication through the wellbore servicing system 100 or a portion thereof. As depicted in the embodiment of FIGS. 1 and 2, the flow path 195 may extend from the wellbore servicing system 100 to the wellhead 180, through the pipe string 140, into the wellbore 120, into the subterranean formation 130, vice-versa (e.g., flow in either direction into or out of the wellbore), or combinations thereof. Persons of ordinary skill in the art with the aid of this disclosure will appreciate that the flow paths 195 described herein or a similar flow path may include various configurations of piping, tubing, etc. that are fluidly connected to each other and/or to one or more components of the wellbore servicing system 100 (e.g., pumps, tanks, trailers, manifolds, mixers/blenders, etc.), for example, via flanges, collars, welds, pipe tees, elbows, and the like.

Turning back to FIGS. 1 and 2, the wellbore servicing system 100 further comprises a flow-back control system 200. In the embodiment of FIGS. 1 and 2, the flow-back control system 200 is incorporated within the wellbore servicing system 100 such that a fluid communicated from the wellbore servicing system 100 (or one or more components thereof) to the wellhead 180, alternatively, through the pipe sting 140, alternatively, into the wellbore 120, alternatively, to/into the subterranean formation 130, will be communicated via the flow-back control system. For example, the flow-back control system 200 may be incorporated and/or integrated within the flow path 195. While the embodiments of FIGS. 1 and 2 illustrate a single flow-back system 200 incorporated/integrated within the flow path 195 at a location between the wellbore servicing manifold 250 and the wellhead 180, this disclosure should not be construed as so-limited. In an alternative embodiment the flow-back control system 200 may be incorporated/integrated within the flow path 195 at any suitable location. For example, in various embodiments, the flow-back control system 200 may be incorporated at another location within the wellbore servicing system 100, alternatively, the flow-back control system 200 may be located at and/or within (e.g., incorporated within) the wellhead 180 (e.g., as a part of the "Christmas tree" assembly), alternatively, within (e.g., integrated within) the pipe string 140, alternatively, at or within the wellbore servicing apparatus 150. In an additional or alternative embodiment, multiple flow-back control systems, as will be disclosed herein, may be incorporated/integrated within the flow path 195 at multiple locations. As will be appreciated by one of skill in the art upon viewing this disclosure, the protection afforded by the flow-back control system 200, as will be disclosed herein, may be at least partially dependent upon the location at which the flow-back control system 200 is integrated within the flow path 195.

In an embodiment, the flow-back control system 200 may be generally configured to allow fluid communication therethrough at a first, relatively higher flow-rate in a first direction and to allow fluid communication therethrough at a second, relatively lower flow-rate in a second, typically opposite direction. In such an embodiment, the first direction of flow may generally be characterized as toward/into the wellbore 120 or subterranean formation 130 (e.g., injecting or pumping into the wellbore/formation) and the second direction of flow may generally be characterized as away from/out of the wellbore 120 or subterranean formation 130 (e.g., producing from the formation to the surface). For example, in an embodiment, the flow-back control system may be configured to allow a fluid (e.g., a wellbore servicing fluid) to be communicated from a relatively upstream position along the flow path 195 (e.g., the wellbore servicing system 100 or a component thereof) in the direction of a relatively downstream position along the flow path 195 (e.g., the wellhead 180, the pipe string 140, the wellbore 120 and/or subterranean formation 130) at a relatively low flow restriction in comparison to flow in the opposite direction (e.g., at a substantially uninhibited rate in comparison to flow through the flow path 195 in the absence of the flow-back control system 200; in other words, the flow-back control system does not choke off or restrict normal flow through the flow path in the first direction). For example, flow through the flow-back control system in a first, non-restricted (or non-metered) direction may be at least about 40 barrels per minute (BPM), alternatively, at least about 50 BPM, alternatively, at least about 60 BPM, alternatively, at least about 70 BMP, alternatively, at least about 80 BPM, alternatively, at least about 90 BPM, alternatively, at least about 100 BPM, alternatively, at least about 120 BPM, alternatively, at least about 140 BPM, alternatively, at least about 160 BPM, alternatively, at least about 180 BPM, alternatively, at least about 200 BPM. Additionally, the flow-back control system 200 may be configured in a second, restricted (or metered) direction to allow a fluid to be communicated from the relatively downstream position along the flow path 195 (e.g., the wellhead 180, the pipe string 140, the wellbore 120 and/or subterranean formation 130) in the direction of the upstream position along the flowpath 195 (e.g., the wellbore servicing system 100 or a component thereof) at a relatively high flow-rate restriction (i.e., at a controlled rate), for example, not more than about 100 BPM, alternatively, not more than about 90 BPM, alternatively, not more than about 80 BPM, alternatively, not more than about 70 BPM, alternatively, not more than about 60 BPM, alternatively, not more than about 50 BPM, alternatively, not more than about 40 BPM, alternatively, not more than about 30 BPM, alternatively, not more than about 25 BPM, alternatively, not more than about 20 BPM, alternatively, not more than about 15 BPM, alternatively, not more than about 12 BPM, alternatively, not more than about 10 BPM, alternatively, not more than about 8 BPM, alternatively, not more than about 6 BPM, alternatively, not more than about 5 BPM, alternatively, not more than about 4 BPM, alternatively, not more than about 3 BPM, alternatively, not more than about 2 BPM.

In an embodiment, the flow-back control system 200 may be configured to be incorporated and/or integrated within the flow path 195. For example, the flow-back control system 200 may comprise a suitable connection to the wellbore servicing system 100 (or a wellbore servicing equipment component thereof), to the wellhead 180, to the pipe string 140, to any fluid conduit extending therebetween, or combinations thereof. For example, the flow-back control system 200 may comprise internally or externally threaded surfaces, suitable for connection via a threaded interface. Alternatively, the flow-back control system 200 may comprise one or more flanges, suitable for connection via a flanged connection. Additional or alternative suitable connections will be known to those of skill in the art upon viewing this disclosure.

In an embodiment, the flow-back control system 200 may comprise (e.g., be formed from) a suitable material. As will be disclosed herein, in operation the flow-back control system 200 may be subjected to relatively high flow rates of various fluids, some of which may be abrasive in nature. As such, in an embodiment, a suitable material may be characterized as relatively resilient when exposed to abrasion. Examples of suitable materials include, but are not limited to, metals (such as titanium), metallic alloys (such as carbon steel, tungsten carbide, hardened steel, and stainless steel), ceramics, polymers (such as polyurethane) or combinations thereof.

In an embodiment, the flow-back control system 200 may comprise a fluidic diode. As used herein, the term "fluidic diode" may refer to a component generally defining a flowpath which exhibits a relatively low restriction to fluid movement (e.g., flow) therethrough in one direction (e.g., the first or "forward" direction) and a relatively high restriction to fluid movement (e.g., flow) therethrough in the opposite direction (e.g., a second or "reverse" direction). Any reference herein to fluid flow in either a "forward" or a "reverse" is solely for the purpose of reference and should not be construed as limiting the flow-back control system 200 or a fluidic diode thereof to any particularly orientation. As used herein, "forward" fluid flow may refer to flow generally into a wellbore and "reverse" fluid flow may refer to flow generally out of the wellbore. As will be disclosed here, a fluidic diode may be configured so as to not prevent (e.g., cease, altogether as is typically provided for example by a check-valve configuration such as a flapper-type safety valve) fluid movement in any particular direction, but rather, may be configured so as to provide variable resistance to fluid movement, dependent upon the direction of the fluid movement. In an embodiment, the flow path defined by a fluidic diode may be characterized as comprising two points of entry into that flow path, for example, a high-resistance entry and a low-resistance entry. For example, fluid movement from the low-resistance entry in the direction of the high-resistance entry may comprise forward flow, as referenced herein (e.g., low-resistance flow); conversely, fluid movement from the high-resistance entry in the direction of the low-resistance entry may comprise reverse flow, as referenced herein (e.g., high-resistance flow).

Additionally, in an embodiment the flow-back control system 200 may comprise two or more fluidic diodes, for example, three, four, five, six, seven, eight, nine, ten, eleven, twelve, or more fluid diodes, for example, arranged in parallel and/or in series and may be spaced in close proximity (e.g., immediately adjacent such that flow exiting one fluidic diode is fed directly into another fluidic diode) and/or may be distributed at distances or intervals along the flow path 195. In such an embodiment, the multiple fluidic diodes may be fluidicly coupled together (e.g., manifolded), for example, so as to provide for a desired total flow rate in either the first and/or second direction. In embodiments, a plurality of fluidic diodes may be coupled in series, in parallel, or combinations thereof to achieve a desired flow characteristic there through.

In an embodiment, the fluidic diode(s) may be configured such that the maximum flow-rate allowed therethrough in the reverse direction (at a given fluid pressure) is not more than 90% of the maximum flow-rate allowed in the forward direction (at the same fluid pressure), alternatively, not more than 80%, alternatively, not more than 70%, alternatively, not more than 60%, alternatively, not more than 50%, alternatively, not more than 40%, alternatively, not more than 30%, alternatively, not more than 20%, alternatively, not more than 10% of the maximum flow-rate allowed in the forward direction.

Referring to FIGS. 3-7, embodiments of various types and/or configurations of the flow-back control systems 200, particularly, one or more embodiments of fluidic diodes which may form a flow path through such fluid control systems, are disclosed herein. As will be appreciated by one of skill in the art upon viewing this disclosure, the suitability of a given type and/or configuration of flow-back control system 200 and/or fluidic diode may depend upon one or more factors including, but not necessarily limited to, the position/location at which the flow-back control system 200 is incorporated within the flow path 195, the intended flow rate at which a fluid may be communicated via the flow-back control system 200 (in one or both directions), the composition/type of fluid(s) intended to be communicated via the flow-back control system 200 (e.g., abrasive fluids, cementitious fluids, solids-laden fluids, etc.), the rheology of the fluid(s) intended to be communicated via the flow-back control system 200, or combinations thereof. In an embodiment, a flow-back control system comprises one or more fluidic diodes having a flow path substantially the same as, the same as, about equal to, equal to, and/or defined by the shape, characteristics, layout, and/or orientation of the flow path shown in any one of FIGS. 3-7.

Figure 5A:
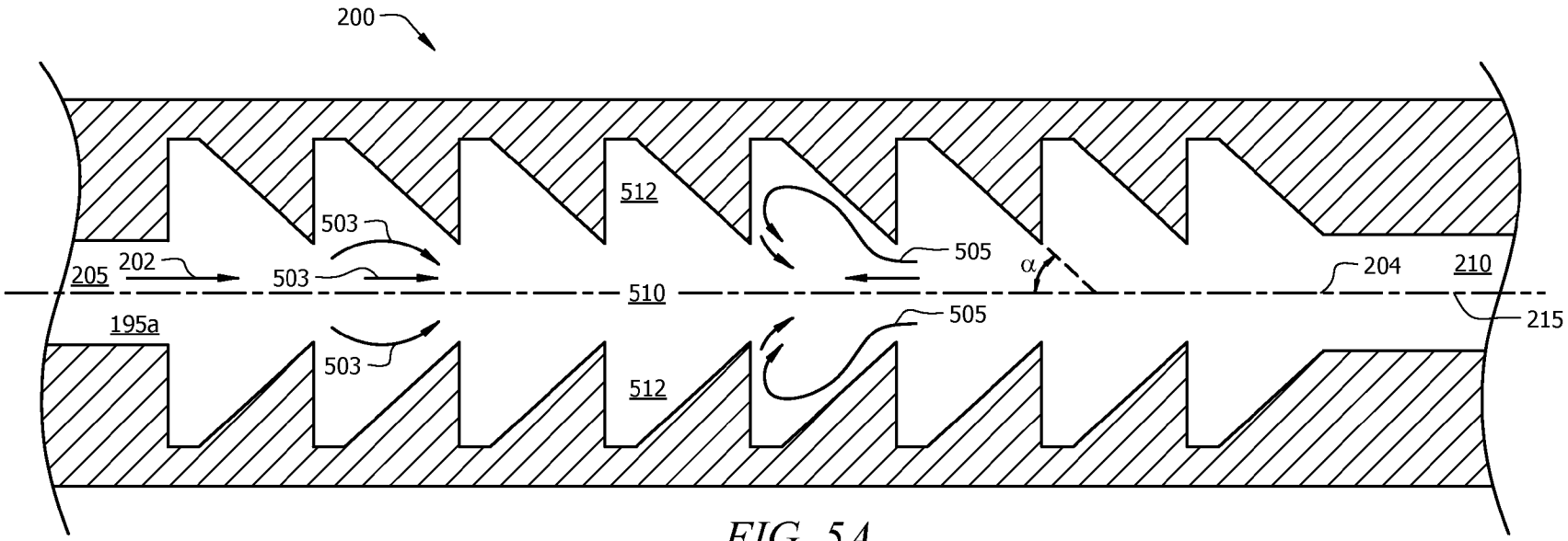
FIG. 5A is a partial cutaway view of an embodiment of a flow-back control system comprising a fluidic diode.
Figure 5B:
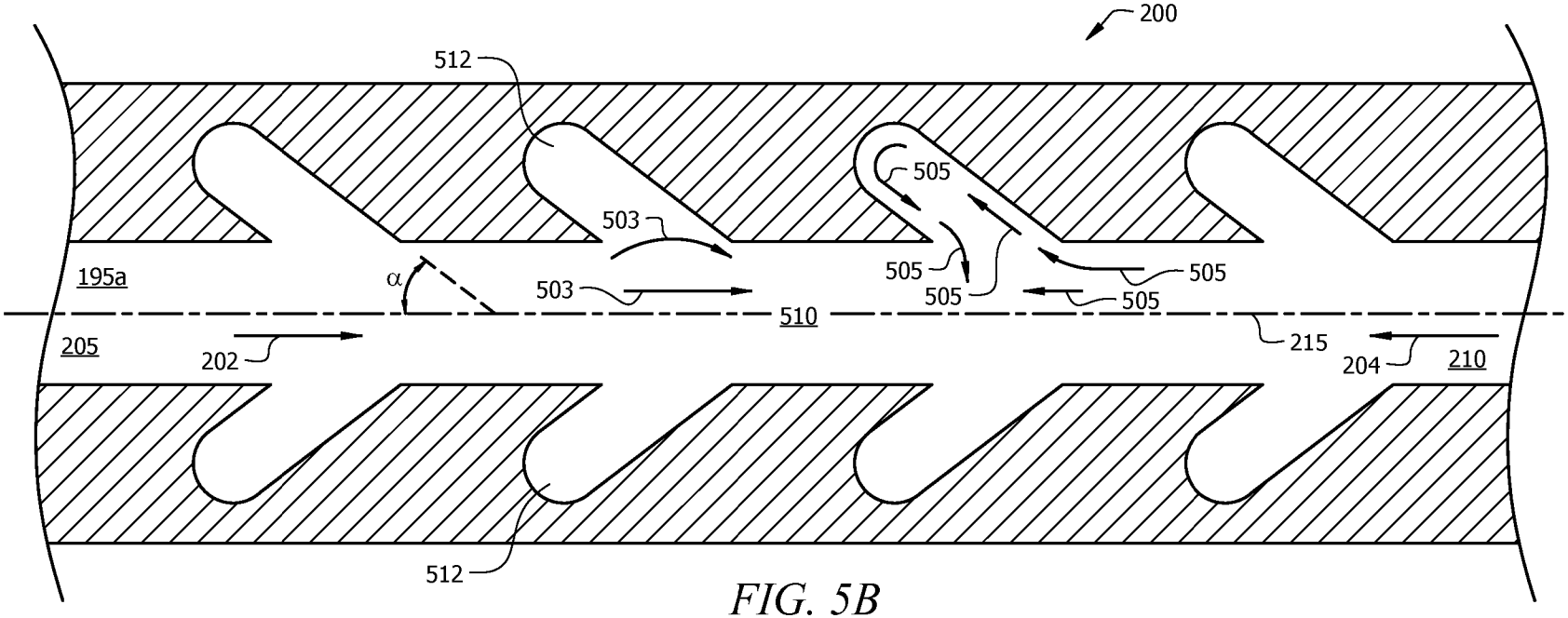
FIG. 5B is a partial cutaway view of an embodiment of a flow-back control system comprising a fluidic diode.
Figure 6:
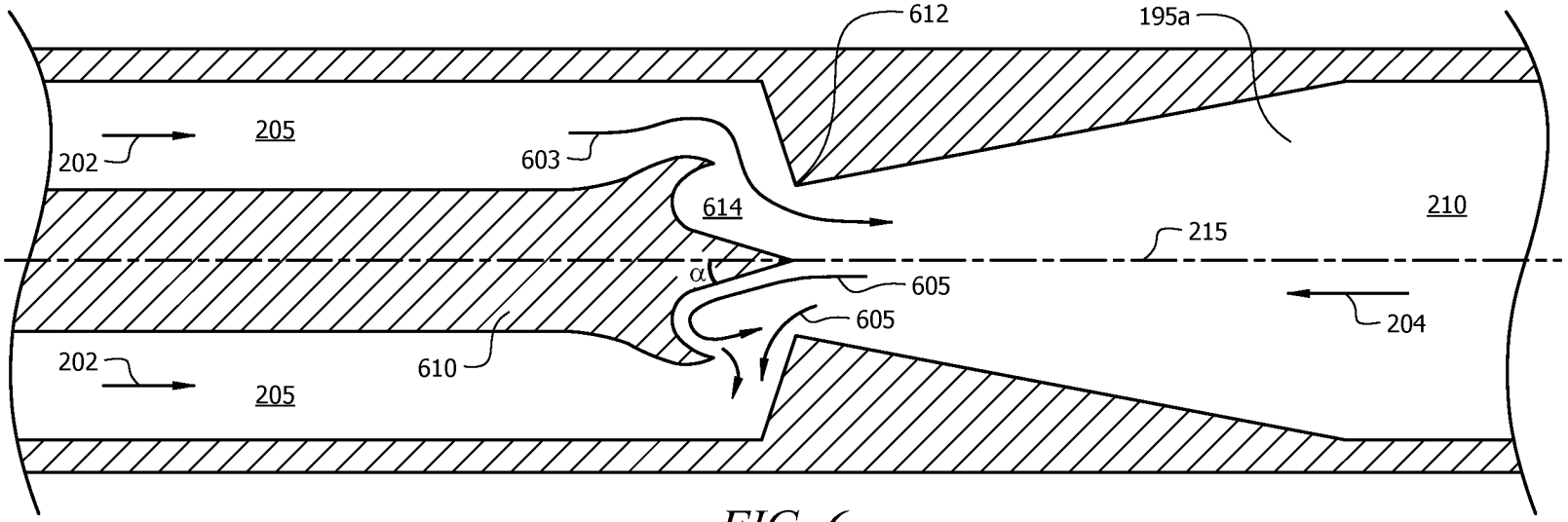
FIG. 6 is a partial cutaway view of an embodiment of a flow-back control system comprising a fluidic diode.
Figure 7:
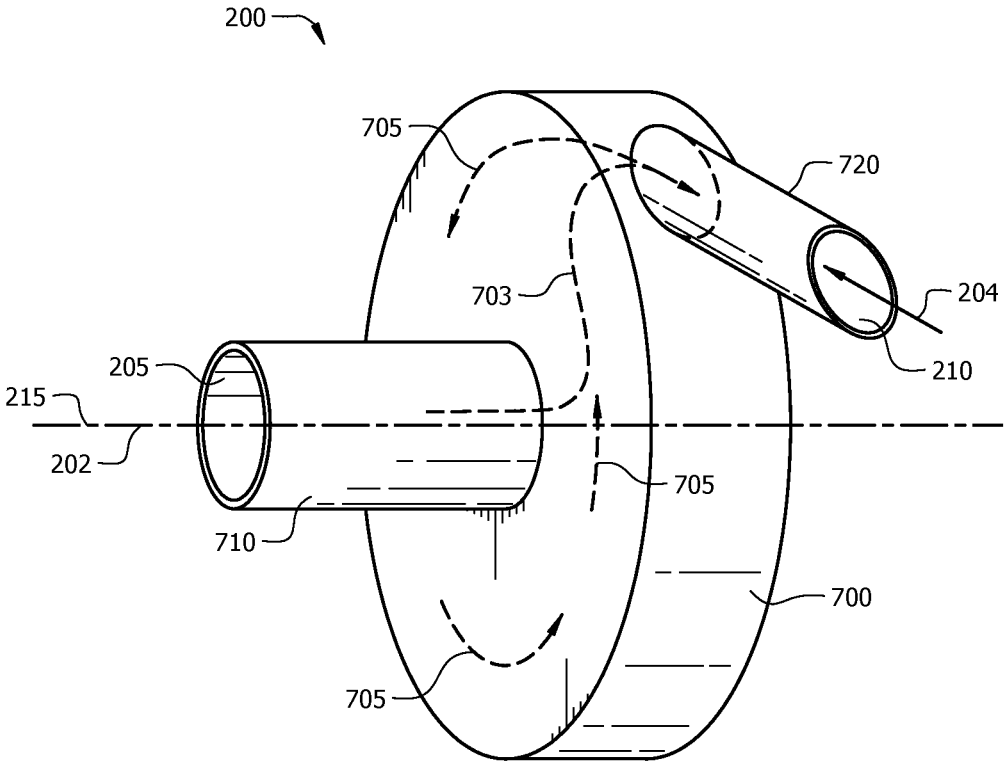
FIG. 7 is a partial cutaway view of an embodiment of a flow-back control system comprising a fluidic diode.

Referring to FIGS. 3-7, embodiments of the flow-back control system 200 comprising a fluidic diode is illustrated. In the embodiments of FIGS. 3-6, as will be disclosed herein, the fluidic diode comprises a generally axial flow path (e.g., a primary flow path that extends generally axially) contained or sealed within a structural support or body. In such embodiments, such axially-extending fluidic diodes may comprise an inner flow profile defined within a body (e.g., a tubular member, a pipe, housing, or the like). Alternatively, such axially-extending fluidic diodes may comprise a series of grooves (e.g., an inlayed pattern) within one or more substantially flat surfaces of a body that may be covered by a cap or top plate to define a sealed flow path. In some embodiments a fluidic diode containing one or more flat surfaces may be further contained within a body (e.g., mandrel, housing, tubular or the like) of any suitable shape (e.g., cylindrical, rectangular, etc.) to facilitate make-up into a wellbore tubular string, the wellbore servicing system 100, or otherwise to facilitate incorporation into the flow path 195. In the embodiment of FIG. 7, as will also be disclosed herein, the flow path primarily defined by the fluidic diode comprises one or more changes in direction and, as such, the flow-back system 200 may comprise a separate and/or dedicated structure. As noted herein, the flow-back control system 200 may have suitable connectors (e.g., flanges, threaded connections, etc.) located at each end of the body to allow incorporation into the flow path 195.

In the embodiments of FIGS. 3-7, the fluidic diodes generally define a flow path 195*a* at least partially extending therethrough. In such embodiments, the flow-back control system 200 is configured such that fluid movement in the forward direction (denoted by flow-arrow 202) will result in a relatively low resistance to flow and such that fluid movement in the reverse direction (denoted by flow-arrow 204) will result in a relatively high resistance to flow.

Figure 3:
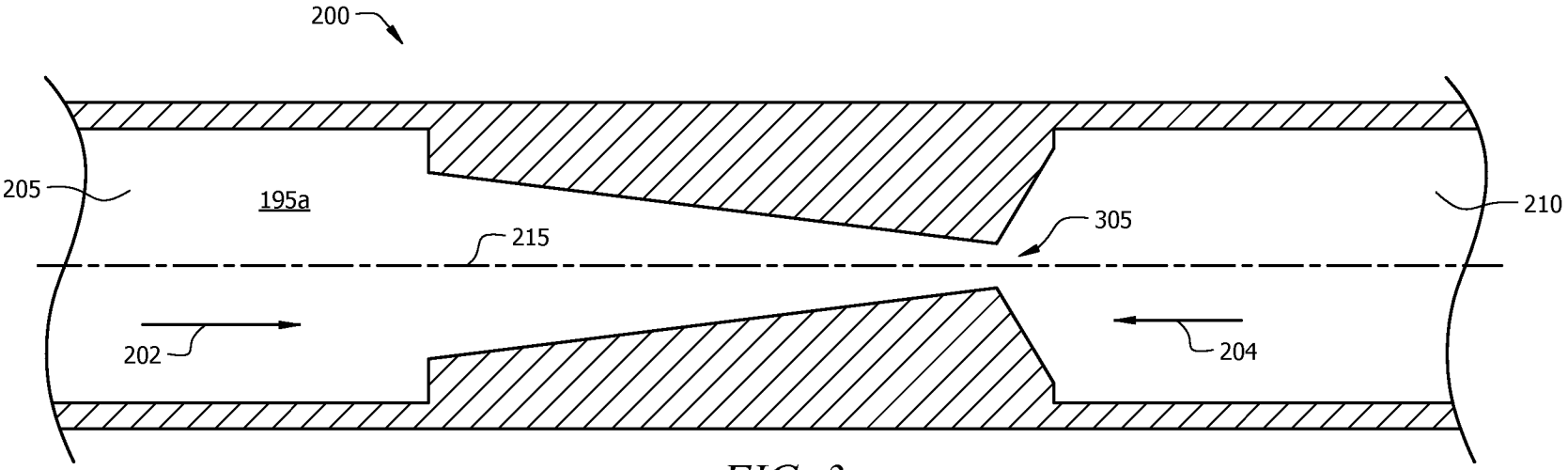
FIG. 3 is a partial cutaway view of an embodiment of a flow-back control system comprising a fluidic diode.

Referring to FIG. 3, a first embodiment of the flow-back control system 200 comprising a fluidic diode is illustrated. In the embodiment of FIG. 3, the fluidic diode generally comprises a nozzle-like configuration, for example a nozzle having a trapezoidal or conical cross-section wherein the larger end of the trapezoid or cone is adjacent to and/or defines the low-resistance entry 205 and the smaller end of the trapezoid or cone is adjacent to and/or defines the high-resistance entry 210. In an embodiment, the nozzle is centered along a central longitudinal axis 215 of flow path 195*a* and having an angle $\alpha$ defining the conical or trapezoidal cross section. Moving in the forward direction, the flow path 195*a* gradually narrows through a nozzle or orifice 305 in the flow path 195*a*. Conversely, moving in the reverse direction, the flow path 195*a* narrows to the orifice 305 substantially more abruptly. Not intending to be bound by theory, the fluidic diode if FIG. 3 may be configured such that fluid movement through the orifice in the forward direction results in a coefficient of discharge through the orifice 305 that is different from the coefficient of discharge resultant from fluid movement through the orifice 305 in the reverse direction. As such, fluid is able to the move through the fluidic diode of FIG. 3 in the forward direction at a flow rate that is substantially greater than the flow rate at which fluid is able to move through the fluidic diode in the reverse direction. Examples of the relationship between nozzle shape flow is demonstrated with regard to various orifice coefficients in Lindeburg, Michael R., Mechanical Engineering Reference Manual, $12^{th}$ ed, pg. 17-17, Professional Publications Inc., Belmont Calif., 2006, which is incorporated herein in its entirety.

Figure 4:
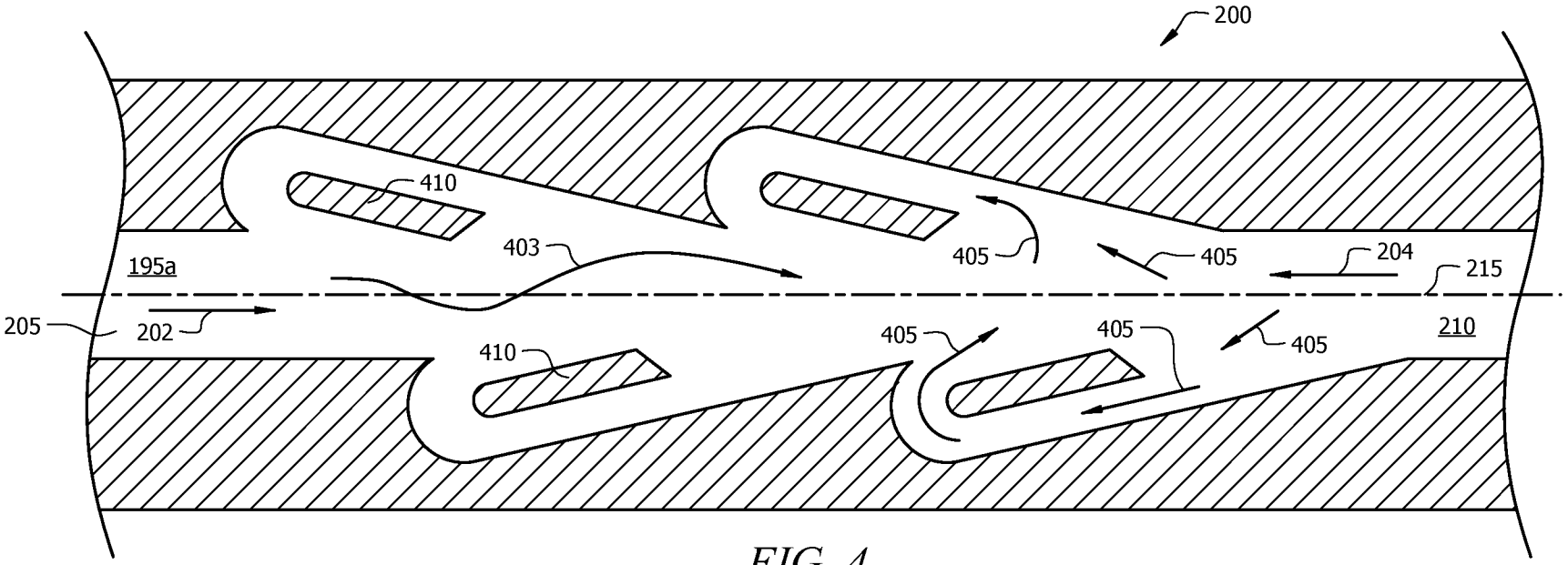
FIG. 4 is a partial cutaway view of an embodiment of a flow-back control system comprising a fluidic diode.

Referring to FIG. 4, a second embodiment of the flow-back control system 200 comprising a fluidic diode is illustrated. In the embodiment of FIG. 4, the fluidic diode generally comprises a Tesla-style fluid conduit. Tesla-style conduits are disclosed in U.S. Pat. No. 1,329,559 to Tesla, which is incorporated herein in its entirety. In the embodiment of FIG. 4, the flow path 195*a* defined by the fluidic diode generally comprises various enlargements, recesses, projections, baffles, or buckets, for example, island-like projections 410 that are surrounded on all sides by flow path 195*a*. Not intending to be bound by theory, the fluidic diode of FIG. 4 may be configured such that fluid movement in the forward direction generally and/or substantially follows a flow path designated by flow arrow 403 (e.g., substantially parallel and co-axial to a central longitudinal axis 215 of the fluidic diode 200 and/or flow path 195*a*) and such that fluid movement in the reverse direction generally and/or substantially follows a flow path designated by flow arrows 405 (e.g., not substantially parallel and co-axial to a central longitudinal axis 215 of the fluidic diode 200 and/or flow path 195*a*, and including areas of flow substantially perpendicular and/or reverse to flow arrow 204). Again not intending to be bound by theory, while the flow path demonstrated by flow arrow 403 (e.g., forward fluid movement) is relatively smooth and continuous along the central longitudinal axis 215, the flow path demonstrated by flow arrows 405 (e.g., reverse fluid movement) is relatively intermittent and broken, being successively accelerated in different directions (e.g., caused to move in one or more directions which may be at least partially opposed to the reverse flow), for example, as a result of the interaction with the multiple island-like projections 405. For example, fluid movement in the reverse direction may cause the formation of various eddies, cross-currents, and/or counter-currents that interfere with, and substantially restrict, fluid movement in the reverse direction. As such, fluid is able to move through the fluidic diode of FIG. 4 in the forward direction with a flow restriction that is substantially lower than the flow restriction at which fluid is able to move through the fluidic diode in the reverse direction.

Referring to FIGS. 5A and 5B, a third and fourth embodiment of a flow-back control system 200, respectively, comprising fluidic diodes are illustrated. In the embodiment of FIGS. 5A and 5B, the fluidic diodes each generally comprise a primary flow path 510 (e.g., substantially parallel and co-axial to a central longitudinal axis 215 of the fluidic diode 200 and/or flow path 510) and further comprising a plurality of secondary flow paths 512 generally extending away from the primary flow path 510 before ceasing (e.g., "dead-ending"), for example, generally extending away from the primary flow path 510 at an angle α in relation to central longitudinal axis 215. In the embodiment of FIG. 5A, the plurality of secondary flow paths 512 may comprise a plurality of pyramidal or trapezoidal, dead-end flow paths forming a notched or saw-tooth like configuration. In the embodiment of FIG. 5B, the plurality of secondary flow paths 512 may comprise a plurality of cylindrical, dead-end flow paths forming an alveoli-like configuration. Not intending to be bound by theory, the fluidic diodes of FIGS. 5A and 5B may be configured such that fluid movement in the forward direction generally and/or substantially follows a flow path designated by flow arrows 503 (e.g., substantially parallel and co-axial to a central longitudinal axis 215 of the fluidic diode 200 and/or flow path 510) and such that fluid movement in the reverse direction generally and/or substantially follows a flow path designated by flow arrows 505 (e.g., not substantially parallel and co-axial to a central longitudinal axis 215 of the fluidic diode 200 and/or flow path 510, and including areas of flow substantially perpendicular and/or reverse to flow arrow 204). Again not intending to be bound by theory, while the flow path demonstrated by flow arrows 503 (e.g., forward fluid movement) are relatively smooth and continuous, the flow path demonstrated by flow arrows 505 (e.g., reverse fluid movement) is relatively intermittent and broken, being successively accelerated in different directions (e.g., caused to move in one or more directions which may be at least partially opposed to the reverse flow), for example, as a result of some portion of the flow in the reverse direction entering the secondary flow paths 512 and, because such secondary flow paths are "dead ends," the fluid within the secondary flow paths 512 being returned to the primary flow path 510 in a direction at least partially against the direction of fluid movement. For example, as similarly disclosed with regard to the embodiment of FIG. 4, fluid movement in the reverse direction may cause the formation of various eddies, cross-currents, and/or counter-currents that interfere with, and substantially restrict, fluid movement in the reverse direction. As such, fluid is able to move through the fluidic diodes of FIGS. 5A and 5B in the forward direction with a flow restriction that is substantially lower than the flow restriction at which fluid is able to move through the fluidic diode in the reverse direction.

Referring to FIG. 6, a fifth embodiment of a flow-back control system 200 comprising a fluidic diode is illustrated. In the embodiment of FIG. 6, the fluidic diode generally comprises a module 610, generally disposed approximately within the center (e.g., co-axial with central longitudinal axis 215) of at least a portion of the flow path 195*a* and extending substantially toward a nozzle or orifice 612 (e.g., a narrowing of the flow path 195*a*). Nozzle or orifice 612 may be conical or trapezoidal as discussed with respect to FIG. 3. The module 610 comprises one or more furrows or valleys 614 facing (e.g., opening toward) the nozzle or orifice 612. In an embodiment, the module 610 may be described as having a crown of trident like cross section having three peaks (a central peak with lesser, minor peaks on either side thereof defining concave surfaces or furrows 615 at an angle α away from the central longitudinal axis 215). Not intending to be bound by theory, the fluidic diode of FIG. 6 may be configured such that fluid movement in the forward direction generally and/or substantially follows a flow path designated by flow arrows 603 and such that fluid movement in the reverse direction generally and/or substantially follows a flow path designated by flow arrows 605. Again not intending to be bound by theory, while the flow path demonstrated by flow arrows 603 (e.g., forward fluid movement) is relatively smooth and continuous, the flow path demonstrated by flow arrows 605 (e.g., reverse fluid movement) is relatively intermittent and broken, being successively accelerated in different directions (e.g., caused to move in one or more directions which may be at least partially opposed to the reverse flow), for example, as a result of the interaction with the furrows 614 of the central module 612 as the fluid moves through the nozzle or orifice 612. For example, fluid movement in the reverse direction may cause the formation of various eddies, cross-currents, and/or counter-currents that interfere with, and substantially restrict, fluid movement in the reverse direction. As such, fluid is able to move through the fluidic diode of FIG. 6 in the forward direction with a flow restriction that is substantially lower than the flow restriction at which fluid is able to move through the fluidic diode in the reverse direction.

Referring to FIG. 7, a sixth embodiment of a flow-back control system 200 comprising a fluidic diode is illustrated. In the embodiment of FIG. 7, the fluidic diode generally comprises a vortex chamber or Zobel diode configuration. In the embodiment of FIG. 7, the flow-back control system 200 generally comprises a cylindrical chamber 700, an axial port 710 (e.g., a fluid inlet or outlet), and a radial port 720 (e.g., a fluid inlet or outlet). In the embodiment of FIG. 7, the axial port 710 is generally positioned so as to introduce a fluid into (alternatively, to receive a fluid from) approximately the center (e.g., co-axial with respect to the central longitudinal axis 215 of the cylinder) of the cylindrical chamber 700. Also, the radial port 720 is generally positioned so as to introduce a fluid into (alternatively, to receive a fluid from) the cylindrical chamber 700 at a position radially removed from the approximate center of the cylindrical chamber 700. The axial port 710 and radial port 720 define flow paths that are about perpendicular to one another and spaced a distance apart (defined by the radius of cylindrical chamber 700) relative to central longitudinal axis 215. For example, in the embodiment of FIG. 7, the radial port 720 is positioned along the circumference of the cylindrical chamber 700 and is generally oriented tangentially to the outer surface of cylindrical chamber 700.

Not intending to be bound by theory, the fluidic diode of FIG. 7 may be configured such that fluid movement in the forward direction generally and/or substantially follows a flow path designated by flow arrow 703 and such that fluid movement in the reverse direction generally and/or substantially follows a flow path designated by flow arrows 705. Again not intending to be bound by theory, the fluidic diode of FIG. 7 may be configured such that, as demonstrated by flow arrow 703 (e.g., forward fluid movement), fluid that enters the cylindrical chamber 700 via the axial port 710 (e.g., the low-restriction entry 205) may flow (e.g., directly) from the axial port 710 and out of the radial port 720. Conversely, the fluidic diode of FIG. 7 may also be configured such that, as demonstrated by flow arrows 705 (e.g., reverse fluid movement), fluid that enters the cylindrical chamber 700 via the radial port 720 (e.g., the high-restriction entry 210) will circulate (e.g., forming a vortex) within the cylindrical chamber 700 and does not flow (e.g., directly) out of the axial port 710. As such, fluid is able to move through the fluidic diode of FIG. 7 in the forward direction with a flow restriction that is substantially lower than the flow restriction at which fluid is able to move through the fluidic diode in the reverse direction.

As noted above, the type and/or configuration of a given fluidic diode, among various other considerations, may bear upon the position and/or location at which the flow-back control system 200 may incorporated within the flow path 195. For example, in an embodiment where the fluidic diode may be incorporated/integrated within a tubular member or other similar axial member or body (e.g., defining the flow path 195*a* of the fluidic diode) as disclosed with reference to FIGS. 3-6, the flow-back control system 200 may be suitably incorporated within the flow path 195 at a location within the wellbore servicing system 100, alternatively, between the wellbore servicing manifold 250 and the wellhead 180, alternatively, at and/or within (e.g., incorporated within) the wellhead 180 (e.g., as a part of the "Christmas tree" assembly), alternatively, within (e.g., integrated within) the pipe string 140. Alternatively, where the flow-back system 200 comprises a separate and/or dedicated structure as disclosed with reference to FIG. 7, the flow-back control system 200 may be incorporated within the flow path 195 at a location within the wellbore servicing system 100, alternatively, between the wellbore servicing manifold 250 and the wellhead 180.

In an embodiment, one or more a flow-back control systems, such as flow-back control system 200 as has been disclosed herein, may be employed in the performance of a wellbore servicing method. In such an embodiment, the wellbore servicing method may generally comprise the steps of providing a wellbore servicing system (for example, the wellbore servicing system 100 disclosed herein), providing a flow path comprising a flow-back control system (e.g., the flow-back control system 200 disclosed herein) between the wellbore servicing system 100 and a wellbore (e.g., wellbore 120), and introducing a fluid into the wellbore 120 via the flow path. In an embodiment, the wellbore servicing method may further comprise allowing fluid to flow from the wellbore at a controlled rate.

In an embodiment, providing the wellbore servicing system may comprise transporting one or more wellbore servicing equipment components, for example, as disclosed herein with respect to FIGS. 1 and 2, to a wellsite 101. In an embodiment, the wellsite 101 comprises a wellbore 120 penetrating a subterranean formation 130. In an embodiment, the wellbore may be at any suitable stage. For example, the wellbore 120 may be newly drilled, alternatively, newly completed, alternatively, previously completed and produced, or the like. As will be appreciated by one of skill in the art upon viewing this application, the wellbore servicing equipment components that are brought to the wellsite 101 (e.g., which will make up the wellbore servicing system 100) may vary dependent upon the wellbore servicing operation that is intended to be performed.

In an embodiment, providing a flow path (for example, flow path 195 disclosed herein) comprising a flow-back control system 200 between the wellbore servicing system 100 and the wellbore 120 may comprise assembling the wellbore servicing system 100, coupling the wellbore servicing system 100 to the wellbore 120, providing a pipe string within the wellbore, or combinations thereof. For example, in an embodiment, one or more wellbore servicing equipment components may be assembled (e.g., fluidicly coupled) so as to form the wellbore servicing system 100, for example, as illustrated in FIG. 2. Also, in an embodiment, the wellbore servicing system 100 may be fluidicly coupled to the wellbore. For example, in the embodiment illustrated by FIG. 2, the manifold 250 may be fluidicly coupled to the wellhead 180. Further, in an embodiment, a pipe string (such as pipe string 140) may be run into the wellbore to a predetermined depth; alternatively, the pipe string 140 may already be present within the wellbore 120.

In an embodiment, providing the flow path 195 comprising a flow-back control system 200 between the wellbore servicing system 100 and the wellbore 120 may also comprise incorporating the flow-back control system 200 within the flow path 195. For example, in an embodiment, the flow-back control system 200 may be fluidicly connected (e.g., fluidicly in-line with flow path 195) during assembly of the wellbore servicing system 100 and/or as a part of coupling the wellbore servicing system 100 to the wellbore 120. Alternatively, in an embodiment, the flow-back control system 200 may be integrated within one or more components present at the wellsite 101. For example, in an embodiment, the flow-back control system 200 may be integrated/incorporated within (e.g., a part of) one or more wellbore servicing equipment components (e.g., of the wellbore servicing system 100, for example as part of the manifold 250), within the wellhead 180, within the pipe string 140, within the wellbore tool 150, or combinations thereof.

In an embodiment, (for example, when the flow path 195 has been provided) a fluid may be introduced in to the wellbore via the flow path 195. In an embodiment, the fluid may comprise a wellbore servicing fluid. Examples of a suitable wellbore servicing fluid include, but are not limited to, a fracturing fluid, a perforating or hydrajetting fluid, an acidizing fluid, the like, or combinations thereof. Additionally, in an embodiment, the wellbore servicing fluid may comprise a composite fluid, for example, having two or more fluid components which may be communicated into the wellbore separately (e.g., via two or more different flow paths). The wellbore servicing fluid may be communicated at a suitable rate and pressure for a suitable duration. For example, the wellbore servicing fluid may be communicated at a rate and/or pressure sufficient to initiate or extend a fluid pathway (e.g., a perforation or fracture) within the subterranean formation 130 and/or a zone thereof.

In an embodiment, for example, as shown in FIGS. 1 and 2, as the fluid is introduced into the wellbore 120 via flow path 195, the fluid (e.g., the wellbore servicing fluid) may be communicated via the flow-back control system 200. In such an embodiment, the wellbore servicing fluid may enter the flow-back control system 200 (e.g., a fluidic diode) via a low resistance entry and exit the flow-back control system 200 via a high resistance entry. As such, the wellbore servicing fluid may experience relatively little resistance to flow when communicated into the wellbore (e.g., in a forward direction).

In addition, because the flow-back control system 200 is configured to allow fluid communication in both directions (e.g., as opposed to a check valve, which operates to allow fluid communication in only one direction), fluid may be flowed in both directions during the performance of the wellbore servicing operation. For example, the wellbore servicing fluid may be delivered into the wellbore at a relatively high rate (e.g., as may be necessary during a fracturing or perforating operation) and returned from the wellbore (e.g., reverse-circulated, as may be necessitated during some servicing operations, for example for fluid recovery, pressure bleed-off, etc.) at a relatively low rate.

In an embodiment, the wellbore servicing method further comprises allowing a fluid to flow from the wellbore 120 at a controlled rate. For example, while undesirable, it is possible that control of the wellbore may be lost, for example, during the performance of a wellbore servicing operation, after the cessation of a servicing operation, or at some other time. Control of the wellbore may be lost or compromised for a number of reasons. For example, control of a wellbore may be compromised as a result of equipment failure (e.g., a broken or ruptured flow conduit, a non-functioning valve, or the like), operator error, or combinations thereof. Regardless of the reason that such uncontrolled flow may occur, because of the presence of the flow-back control system 200, any such flow of fluids out of the wellbore may occur at a controlled rate, alternatively, at a substantially controlled rate. For example, fluid escaping from the wellbore 120 (e.g., from the wellhead 180) may flow out of the wellbore 120 via the flow-back control system 200. In such an embodiment, the fluid flowing out of the wellbore may enter the flow-back control system 200 (e.g., a fluidic diode) via the high resistance entry and exit the flow-back control apparatus via the low-resistance entry. As such, the wellbore servicing fluid may experience relatively high resistance to flow when communicated out of the wellbore. Therefore, the fluid flowing out of the wellbore may do so at a substantially controlled rate. In an embodiment, when such an unintended flow of fluids occurs, the flow-back control apparatus 200 may allow such fluids to be communicated at a rate sufficiently low so as to allow the wellbore to again be brought under control (e.g., for well control to be re-established). For example, because the fluid will only flow out of the wellbore at a controlled rate (e.g., via the operation of the flow-back control system 200), the area surrounding the wellbore (e.g., the wellsite) may remain safe, thereby allowing personnel to manually bring the wellbore under control (e.g., using a manually operated valve located at the wellhead 180).

In an embodiment, a flow-back control system, such as the flow-back control system 200 disclosed herein, and/or methods of utilizing the same, may be advantageously employed, for example, in the performance of a wellbore servicing operation. As disclosed herein, the utilization of such a flow-back control system may allow fluid movement, both into and out of a wellbore, at an appropriate rate. For example, the flow-back control system may be configured so as to allow fluid to be communicated into a wellbore at a rate sufficiently high to stimulate e.g., fracture or perforate) a subterranean formation and to allow fluid to be communicated out of the wellbore at a rate sufficiently low to provide improved safety (e.g., from unexpected fluid discharges) to operators and/or personnel present in the area around the wellbore.

In an embodiment, check valves have been conventionally employed at and/or near the wellhead, for example, to prevent the unintended escape of fluids. However, such check valves are configured to permit flow therethrough in only a first direction while prohibiting entirely flow therethrough in a second direction. As such, a check valve would not control the escape of fluids during a point during an operation when such check valve was deactivated (e.g., during reverse circulation or reverse-flowing). Moreover, check valves generally utilize moving parts and, as such, exposure to high flow-rates of relatively abrasive fluids (e.g., wellbore servicing fluids) may damage and/or render inoperable such check valves. Conversely, in an embodiment, the flow-back control system may comprise relatively few (for example, none) moving parts and, as such, may be far less susceptible to failure or degradation. Also, by allowing some fluid flow in the reverse direction (as opposed to complete shut-off of fluid flow in the reverse direction by a check valve), undesirably high pressure spikes may be lessened or avoided by the use of the flow-back control systems comprising fluidic diodes as disclosed herein, further protecting personnel and equipment from injury or damage that may occur from over-pressurization of equipment. The use of flow-back control systems comprising fluidic diodes as disclosed herein, while not completely shutting off reverse flow, may reduce/restrict reverse flow for a sufficient time and/or reduction in flow rate or pressure to allow other safety systems to be activated and/or to function (e.g., an additional amount of time for a blow-out preventer to be activated and/or fully close).

ADDITIONAL DISCLOSURE

The following are nonlimiting, specific embodiments in accordance with the present disclosure:

A first embodiment, which is a wellbore servicing system disposed at a wellbore, the wellbore servicing system comprising:

at least one wellbore servicing equipment component, wherein a flow path extends from the wellbore servicing system component into the wellbore, and a flow-back control system, wherein the flow-back control system is disposed along the flow path, and wherein the flow-back control system is configured to allow fluid communication via the flow path in a first direction at not less than a first rate and to allow fluid communication via the flow path in a second direction at not more than a second rate, wherein the first rate is greater than the second rate.

A second embodiment, which is the wellbore servicing system of the first embodiment, wherein the wellbore servicing equipment component comprises a mixer, a pump, a wellbore services manifold, a storage vessel, or combinations thereof.

A third embodiment, which is the wellbore servicing system of one of the first through the second embodiments, wherein the first direction is generally into the wellbore.

A fourth embodiment, which is the wellbore servicing system of one of the first through the third embodiments, wherein the second direction is generally out of the wellbore.

A fifth embodiment, which is the wellbore servicing system of one of the first through the fourth embodiments, wherein the first rate comprises a relatively high rate and the second rate comprises a relatively low rate.

A sixth embodiment, which is the wellbore servicing system of one of the first through the fifth embodiments, wherein the flow-back control system comprises a fluidic diode.

A seventh embodiment, which is the wellbore servicing system of the sixth embodiment, wherein the fluidic diode comprises a relatively high-resistance entry and a relatively low-resistance entry.

An eighth embodiment, which is the wellbore servicing system of one of the sixth through the seventh embodiments, wherein the fluidic diode generally defines a diode flow path, wherein the diode flow path is in fluid communication with the flow path.

A ninth embodiment, which is the wellbore servicing system of the eighth embodiment, wherein the diode flow path comprises a primary diode flowpath and one or more secondary diode flow paths, wherein flow in the first direction is along the primary diode flowpath and flow in the second direction is along the one or more secondary diode flow paths.

A tenth embodiment, which is the wellbore servicing system of the eighth embodiment, wherein the diode flow path comprises a plurality of island-like projections or more protrusions.

An eleventh embodiment, which is the wellbore servicing system of the eighth embodiment, wherein the diode flow path comprises a nozzle.

A twelfth embodiment, which is the wellbore servicing system of the eighth embodiment, wherein the diode flow path comprises a vortex.

A thirteenth embodiment, which is the wellbore servicing system of one of the first through the twelfth embodiments, wherein the flow-back control system comprises no moving parts.

A fourteenth embodiment, which is the wellbore servicing system of one of the sixth through the thirteenth embodiments, wherein the fluidic diode has a flow path as shown in any one of FIGS. 3-7.

A fifteenth embodiment, which is the wellbore servicing system of one of the first through the fourteenth embodiments, wherein the first rate is at least 1.5, 2, 2.5, 3, 3.5, 4, 4.5, 5, 6, 7, 8, 9, 10, or 12 times greater than the second flow rate.

A sixteenth embodiment, which is a wellbore servicing method comprising:

providing a flow path between a wellbore servicing system and a wellbore penetrating a subterranean formation, wherein a flow-back control system comprising a fluidic diode is disposed along the flow path at the surface of the subterranean formation; and communicating a fluid via the flow path in a first direction at not less than a first rate.

A seventeenth embodiment, which is the method of the sixteenth embodiment, further comprising allowing a fluid to flow through at least a portion of the flow path in a second direction, wherein fluid flowing through the flow path in the second direction is communicated at a rate of not more than a second rate.

An eighteenth embodiment, which is the method of the seventeenth embodiment, wherein the first rate comprises a relatively high rate and the second rate comprises a relatively low rate.

A nineteenth embodiment, which is the method of one of the seventeenth through the eighteenth embodiments, wherein the first direction is generally into the wellbore and the second direction is generally out of the wellbore.

A twentieth embodiment, which is the method of one of the seventeenth through the nineteenth embodiments, wherein movement of fluid through the fluidic diode in the first direction may be characterized as relatively low-resistance.

A twenty-first embodiment, which is the method of one of the seventeenth through the twentieth embodiments, wherein movement of fluid through the fluidic diode in the second direction may be characterized as relatively high-resistance.

A twenty-second embodiment, which is the method of one of the seventeenth through the twenty-first embodiments, wherein movement of fluid through the fluidic diode in the first direction may be characterized as relatively continuous and uninterrupted.

A twenty-third embodiment, which is the method of one of the seventeenth through the twenty-second embodiments, wherein movement of fluid through the fluidic diode in the second direction may be characterized as contributing to the formation of eddies, cross-currents, counter-currents, or combinations thereof, wherein the eddies, cross-currents, counter-currents, or combinations thereof interfere with fluid movement in the second direction.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A wellbore servicing system disposed at a wellbore, the wellbore servicing system comprising:

at least one wellbore servicing equipment component, wherein a wellbore servicing flow path extends from the wellbore servicing equipment component into the wellbore, a flow-back control system, wherein the flow-back control system is disposed along the wellbore servicing flow path to allow fluid communication in a first direction and a second direction, and wherein the flow-back control system is configured to allow fluid communication via the wellbore servicing flow path in the first direction at not less than a first rate and to allow fluid communication via the wellbore servicing flow path in the second direction at not more than a second rate, wherein the first rate is greater than the second rate;

wherein the flow-back control system comprises a fluidic diode disposed between a first conduit and a second conduit, wherein the fluidic diode defines a diode flow path, wherein the wellbore servicing flow path comprises the diode flow path, and wherein the first conduit and the second conduit are co-axial with the diode flow path, and wherein the second rate is between 10% and 90% of the first rate.

2. The wellbore servicing system of claim 1, wherein the wellbore servicing equipment component comprises a mixer, a pump, a wellbore services manifold, a storage vessel, or combinations thereof.

3. The wellbore servicing system of claim 1, wherein the first direction is into the wellbore.

4. The wellbore servicing system of claim 1, wherein the second direction is out of the wellbore.

5. The wellbore servicing system of claim 1, wherein the first rate is at least 1.5 times the second rate.

6. The wellbore servicing system of claim 5, wherein the first rate is at least 5 times greater than the second rate.

7. The wellbore servicing system of claim 1, wherein the second conduit comprises a high-resistance entry and the first conduit comprises a low-resistance entry.

8. The wellbore servicing system of claim 1, wherein the diode flow path comprises a primary diode flow path and one or more secondary diode flow paths, wherein flow in the first direction is along the primary diode flow path and flow in the second direction is along the one or more secondary diode flow paths.

9. The wellbore servicing system of claim 1, wherein the diode flow path comprises a plurality of projections or protrusions.

10. The wellbore servicing system of claim 1, wherein the diode flow path comprises a nozzle.

11. The wellbore servicing system of claim 1, wherein the diode flow path comprises a vortex chamber.

12. The wellbore servicing system of claim 1, wherein the flow-back control system comprises no moving parts.

13. The wellbore servicing system of claim 1, wherein movement of fluid through the fluidic diode in the second direction forms eddies, cross-currents, counter-currents, or combinations thereof, wherein the eddies, cross-currents, counter-currents, or combinations thereof interfere with fluid movement in the second direction.

14. A wellbore servicing method comprising:

providing a wellbore servicing flow path between a wellbore servicing system and a wellbore penetrating a subterranean formation, wherein a flow-back control system comprising a fluidic diode is disposed along the wellbore servicing flow path between a first conduit and a second conduit to allow fluid communication in a first direction and a second direction, wherein the fluidic diode defines a diode flow path in fluid communication with the wellbore servicing flow path via the first and second conduits, wherein the diode flow path is co-axial with the first conduit and the second conduit; and communicating a fluid via the flow path in the first direction at not less than a first rate, allowing a fluid to flow through at least a portion of the wellbore servicing flow path in a second direction at a rate of not more than a second rate wherein the second rate is between 10% and 90% of the first rate.

15. The method of claim 14, wherein the first rate is at least two times the second rate.

16. The method of claim 14, wherein the first direction is into the wellbore and the second direction is out of the wellbore.

17. The method of claim 14, wherein movement of fluid has a lower resistance through the fluidic diode in the first direction than in the second direction.

18. The method of claim 14, wherein movement of fluid has a higher resistance through the fluidic diode in the second direction than through the flow path in the first direction.

19. The method of claim 14, wherein movement of fluid through the fluidic diode in the first direction is continuous and uninterrupted.

20. The method of claim 14, wherein movement of fluid through the fluidic diode in the second direction forms eddies, cross-currents, counter-currents, or combinations thereof, wherein the eddies, cross-currents, counter-currents, or combinations thereof interfere with fluid movement in the second direction.

* * * * *